US011718998B2

(12) United States Patent
Haddock et al.

(10) Patent No.: US 11,718,998 B2
(45) Date of Patent: Aug. 8, 2023

(54) STAIR STRINGER

(71) Applicant: MIRO Industries, Inc., Heber City, UT (US)

(72) Inventors: Jason Reed Haddock, Heber City, UT (US); Jarrett Alan Welch, Herber City, UT (US); John Nathan Post, Heber, UT (US); Gary J R Kummer, Orem, UT (US); Samuel Richard Robins, Heber City, UT (US)

(73) Assignee: MIRO Industries, Inc., Heber City, UT (US)

( * ) Notice: Subject to any disclaimer, the term of this patent is extended or adjusted under 35 U.S.C. 154(b) by 55 days.

(21) Appl. No.: 17/405,895

(22) Filed: Aug. 18, 2021

(65) Prior Publication Data

US 2023/0058386 A1 Feb. 23, 2023

(51) Int. Cl.
*E04F 11/00* (2006.01)
*E04F 11/025* (2006.01)

(52) U.S. Cl.
CPC ..... *E04F 11/025* (2013.01)

(58) Field of Classification Search
CPC ..... E04F 11/025
See application file for complete search history.

(56) References Cited

U.S. PATENT DOCUMENTS 508,308 A * 11/1893 Haines ..... E01F 9/541 52/250
1,701,659 A * 2/1929 Bechtel ..... E04F 11/025 52/191
2,021,457 A 11/1935 Mackenzie
2,724,466 A * 11/1955 Phillips ..... E04F 11/022 52/191
3,021,928 A * 2/1962 Blair ..... E04F 11/025 52/690

(Continued)

FOREIGN PATENT DOCUMENTS

DE 102011015492 A1 10/2012
EA 030860 A1 2/2018

OTHER PUBLICATIONS

Core77, "Ascendings: Building a better staircase using modular components," retrieved on Aug. 17, 2021 at <<https://www.core77.com/posts/18244/ascendings-building-a-better-staircase-using-modular-components-18244#>>, 17 pages.

(Continued)

*Primary Examiner* — Basil S Katcheves
(74) *Attorney, Agent, or Firm* — Lee & Hayes, P.C.

(57) ABSTRACT

A stair stringer may include a body. The body may include a horizontal arm, a center angled portion coupled to the horizontal arm, and a vertical arm coupled to the center angled portion. The stair stringer may also include a first appendage coupled to a first edge of the horizontal arm, a second appendage coupled to a second edge of the horizontal arm, a third appendage coupled to a third edge of the vertical arm, and a fourth appendage coupled to a fourth edge of the vertical arm. The fourth edge may be adjacent the third edge. The first appendage, the second appendage, and the third appendage are parallel with respect to one another. A stairway system may include a first stair stringer and a second stair stringer. The second stair stringer may be an architectural chiral with respect to the first stair stringer.

20 Claims, 18 Drawing Sheets

(56) References Cited

U.S. PATENT DOCUMENTS

| | | | | | |
|---|---|---|---|---|---|
| 3,099,336 | A * | 7/1963 | Hawkins | E04F 11/035 | 182/178.1 |
| 3,667,572 | A * | 6/1972 | Anderson | E04F 11/025 | 182/220 |
| 3,897,665 | A | 8/1975 | Yokomori | | |
| D256,663 | S | 9/1980 | Gilb | | |
| 4,422,270 | A | 12/1983 | Lapointe et al. | | |
| 4,709,520 | A * | 12/1987 | Vochatzer | E04F 11/025 | 182/220 |
| 4,819,391 | A | 4/1989 | Tassin | | |
| D361,541 | S | 8/1995 | Denny | | |
| 5,791,101 | A * | 8/1998 | Wallace | E04F 11/025 | 52/182 |
| 5,799,448 | A * | 9/1998 | Dunk | E04F 11/0255 | 52/179 |
| 5,806,254 | A * | 9/1998 | Bennett | E04F 11/035 | 52/712 |
| 6,088,977 | A | 7/2000 | Lawrence | | |
| 6,758,016 | B2 * | 7/2004 | Gobeil | E04F 11/1041 | 33/476 |
| 6,860,460 | B2 | 3/2005 | Rellergert | | |
| D619,270 | S | 7/2010 | Charette | | |
| D621,067 | S | 8/2010 | Charette | | |
| D632,159 | S | 2/2011 | Charette | | |
| 7,946,085 | B2 * | 5/2011 | Prins | E04F 11/1041 | 52/191 |
| 8,601,746 | B1 * | 12/2013 | Karaim | E04D 3/3608 | 52/715 |
| 8,720,839 | B2 * | 5/2014 | Lijesnic | A47B 47/0033 | 403/231 |
| D735,170 | S | 7/2015 | Colvin | | |
| 9,212,491 | B1 * | 12/2015 | Santini | E04F 11/025 | |
| D806,903 | S | 1/2018 | Fraas | | |
| D834,732 | S | 11/2018 | Charette | | |
| D864,854 | S | 10/2019 | Sinai | | |
| D899,894 | S | 10/2020 | Lundy | | |
| D925,338 | S | 7/2021 | DeDios-Shirley | | |
| D944,079 | S | 2/2022 | Young | | |
| D959,237 | S | 8/2022 | Mantenuto | | |
| D966,076 | S | 10/2022 | Charette | | |
| 2001/0027627 | A1 * | 10/2001 | Lawrence | E04F 11/025 | 52/182 |
| 2002/0124492 | A1 * | 9/2002 | Gobeil | E04F 11/00 | 52/191 |
| 2003/0093959 | A1 | 5/2003 | Couture | | |
| 2004/0040785 | A1 | 3/2004 | Robinson et al. | | |
| 2009/0056268 | A1 * | 3/2009 | Greenlee | E04B 1/2608 | 52/702 |
| 2009/0293385 | A1 | 12/2009 | Vargas | | |
| 2013/0074429 | A1 | 3/2013 | Lehtinen et al. | | |
| 2020/0109567 | A1 | 4/2020 | Burt et al. | | |
| 2021/0087821 | A1 * | 3/2021 | Charette | E04F 11/1863 | |

OTHER PUBLICATIONS

Office Action for U.S. Appl. No. 17/405,895, dated Dec. 13, 2022, Haddock, "Stair Stringer", 7 pages.

* cited by examiner

STAIR STRINGER

TECHNICAL FIELD

The present disclosure relates generally to building construction features. Specifically, the present disclosure relates to a stair stringer and systems and methods for creating a stairway utilizing a number of the stair stringers.

BACKGROUND

A stairway provides an individual with access to different levels of a structure such as a building or home by bridging a large vertical distance via a number of smaller vertical distances referred to as treads. Treads allow a user of a stairway to safely vertically navigate a change in elevation. In some instances, external areas of a building may include a rooftop area. Several roofing structures and elements may be installed on rooftops. These structures and elements may include split-level rooftop areas apply a stairway for various reasons. For example, a stairway may be used to access rooftop equipment such as heating, ventilation, and air conditioning (HVAC) equipment and an associated access platform. Further, a stairway may be used to provide access to portions of a rooftop that have different in elevations. Still further, a stairway may provide a means by which a user may cross over rooftop devices and elements such as piping.

BRIEF DESCRIPTION OF THE DRAWINGS

The detailed description is set forth below with reference to the accompanying figures. In the figures, the left-most digit(s) of a reference number identifies the figure in which the reference number first appears. The use of the same reference numbers in different figures indicates similar or identical items. The systems depicted in the accompanying figures are not to scale and components within the figures may be depicted not to scale with each other.

DESCRIPTION OF EXAMPLE EMBODIMENTS

Figure 1:
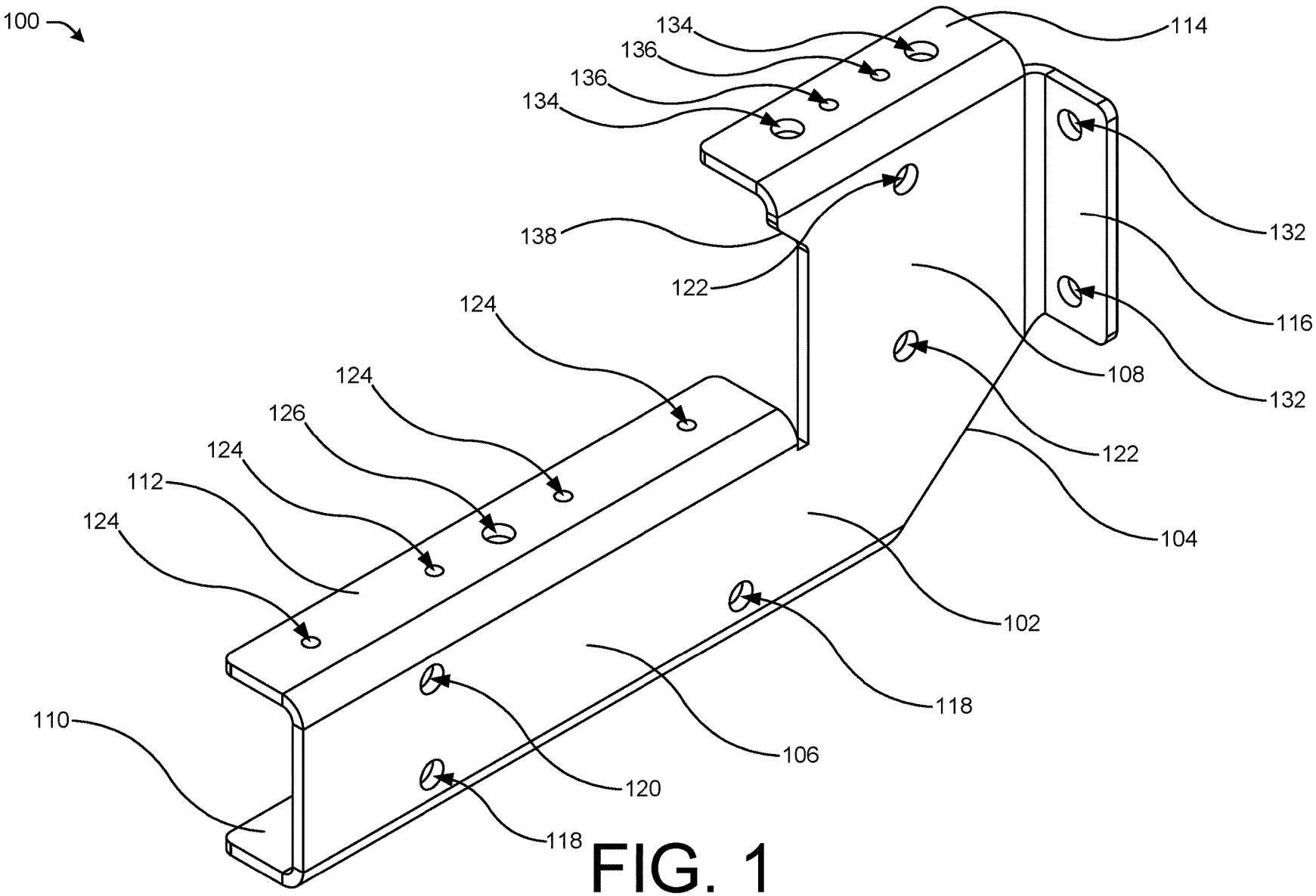
FIG. 1 illustrates a top first perspective view of a right stair stringer, according to an example of the principles described herein.

In some instances, stairways may be used external to a building including a roof area. Several roofing structures and elements may apply a stairway for various reasons. For example, a stairway may be used to access rooftop equipment such as heating, ventilation, and air conditioning (HVAC) equipment and an associated access platform. Further, a stairway may be used to provide access to portions of a rooftop that have different in elevations. Still further, a stairway may provide a means by which a user may cross over rooftop devices and elements such as piping.

However, in some instances, providing large stairway systems to rooftops may require heavy machinery such as cranes, and may be difficult to install and maintain. This may be due at least partially to a stringer of the stairway system that causes the stairway system to be large and cumbersome. In instances where the structure on the roof of which the stairway system is to be installed is being newly built, such prefabricated stairway systems may be hoisted onto the roof. However, in instances where a stairway system of an existing structure needs replaced or where a new stairway structure is to be installed on the roof of an existing building, it may be much more difficult to access the rooftop with the prefabricated stairway system.

Further, in instances where a prefabricated stairway system is installed, the dimensions of the prefabricated stairway system may not be adjusted. This may, in turn, reduce the ability for new and/or additional rooftop elements such as HVAC and piping to be added, rearranged, or reoriented along the surface of the rooftop, and may also reduce the ability for these devices to be serviced. This is because the height and/or width of the prefabricated stairway system cannot be altered to accommodate these additional elements.

Overview

In the examples described herein, a modular stairway system including a number of right and left stringers. The right and left stringers may be coupled to one another to create a stairway system of any height and dimension. Because the right and left stringers may be used to build a stairway of varying dimensions (e.g., height and width), an installer of the present stair systems may more efficiently and safely install the stair systems by utilizing the individual right and left stair stringers and their associated treads, spacers, platforms, and rail systems. Further, the installer may easily and safely modify the stair system without the need to handle large stringers since the individual stair stringers may be decoupled and coupled as needed.

Examples described herein provide a stair stringer. The stair stringer may include a body. The body may include a horizontal arm, a center angled portion coupled to the horizontal arm, and a vertical arm coupled to the center angled portion. The stair stringer may also include a first appendage coupled to a first edge of the horizontal arm, a second appendage coupled to a second edge of the horizontal arm, a third appendage coupled to a third edge of the vertical arm, and a fourth appendage coupled to a fourth edge of the vertical arm. The fourth edge may be adjacent the third edge. The first appendage, the second appendage, and the third appendage are parallel with respect to one another.

A vertical distance between the second appendage of a first stair stringer and the second appendage of a second stair stringer coupled to the first stair stringer may define a rise between two treads of a stairway. A horizontal distance from a first end of the horizontal arm and a second end of the horizontal arm may define a tread depth of a tread a stairway.

The stair stringer may further include a nosing extending from the vertical arm. The third appendage may extend to an extent of the nosing. The stair stringer may further include a number of first apertures defined in the first appendage. The first apertures may be aligned with a number of second apertures defined in the third appendage such that the first appendage of a first stair stringer is couplable to the third appendage of a second stair stringer. The stair stringer may further include a number of apertures defined in the first appendage. The apertures may be aligned with a corresponding number of fasteners of a base such that the first appendage is couplable to the base. The stair stringer may further include a number of first apertures defined in the second appendage. The first apertures may be aligned with a corresponding number of second apertures defined in a tread such that the second appendage is couplable to the tread via a number of fasteners.

The stair stringer may further include a number of apertures defined in the fourth appendage to couple the stair stringer to a structure via a number of fasteners extended through the apertures and into the structure. The stair stringer may further include a number of apertures defined in the vertical arm and the horizontal arm to couple the stair stringer to a structure via a number of fasteners extended through the apertures and into the structure.

Examples described herein may also provide a stairway system. The stairway system may include a first stair stringer and a second stair stringer. The second stair stringer may be an architectural chiral with respect to the first stair stringer. The first stair stringer and the second stair stringer may include a body. The body may include a horizontal arm, a center angled portion coupled to the horizontal arm, and a vertical arm coupled to the center angled portion, a first appendage coupled to a first edge of the horizontal arm, a second appendage coupled to a second edge of the horizontal arm, a third appendage coupled to a third edge of the vertical arm, and a fourth appendage coupled to a fourth edge of the vertical arm, the fourth edge being adjacent the third edge. The stairway system may further include a tread coupling the first stair stringer to the second stair stringer.

The first appendage, the second appendage, and the third appendage may be parallel with respect to one another. A vertical distance between the second appendage of a first stair stringer and the second appendage of a third stair stringer coupled to the first stair stringer defines a rise between the treads of a stairway. A horizontal distance from a first end of the horizontal arm and a second end of the horizontal arm defines a tread depth of the tread.

The stairway system may further include a nosing extending from the vertical arm. The third appendage extending to an extent of the nosing. The stairway system may further include at least one of a number of first apertures defined in the first appendage, the first apertures being aligned with a number of second apertures defined in the third appendage such that the first appendage of a higher stair stringer is couplable to the third appendage of a lower stair stringer in a series of stair stringers; a number of third apertures defined in the first appendage, the third apertures being aligned with a corresponding number of first fasteners of a base such that the first appendage is couplable to the base; a number of fourth apertures defined in the second appendage, the fourth apertures being aligned with a corresponding number of apertures defined in the tread such that the second appendage is couplable to the tread via a number of second fasteners; a number of fifth apertures defined in the fourth appendage to couple the first stair stringer or the second stair stringer to a structure via a number of third fasteners extended through the fifth apertures and into the structure; a number of sixth apertures defined in the vertical arm and the horizontal arm to couple the first stair stringer or the second stair stringer to a structure via a number of fourth fasteners extended through the apertures and into the structure; and combinations thereof.

The stairway system may further include a handrail system coupled to the stairway system via the first stair stringer and the second stair stringer. The stairway system may further include a number of cross supports coupled to the handrail system. The stairway system may further include a platform coupled to a number of first stair stringers and a corresponding number of second stair stringers. The stairway system may further include a number of struts coupled to the stairway system via the first stair stringer and the second stair stringer. The stairway system may further include a number of riser spacers coupled to the third appendage of the vertical arm. The stairway system may further include a number of bases coupled to a lowest one of a number of the first stair stringers and a corresponding number of the second stair stringers.

Example Embodiments

Turning now to the figures, FIGS. 1 through 4 illustrate a right stair stringer 100 and FIGS. 5 through 8 illustrate a left stair stringer 200. The right stair stringer 100 FIG. 1 is architecturally chiral with respect to the left stair stringer 200, and vice versa. As used in the present specification and in the appended claims, the terms "chiral," "architecturally chiral," or similar language is meant to be understood broadly as any structural characteristic of the element that makes it impossible to superimpose it on its mirror image and/or that includes a right-form and a left-form. The right stair stringer 100 and the left stair stringer 200 described herein are geometrical figures including a group or number of points wherein their respective images in a plane mirror, ideally realized, cannot be brought to coincide with itself. In this manner, the right stair stringer 100 and the left stair stringer 200 serve to support a tread from opposite sides of the tread. Further, when a number of the right stair stringers 100 are coupled together and a corresponding number of the left stair stringers 200 are coupled together, the sets of right stair stringers 100 and the left stair stringers 200 may be used to couple a corresponding number of treads between the sets to form a stairway or staircase including a number of treads. More regarding the manner in which the right stair stringers 100 and the left stair stringers 200 are utilized to create a stairway are described below. In the below description of the right stair stringer 100 and the left stair stringer 200, the use of similar numbers identified in the drawings will be used to describe similar, chirally-related features and elements.

Figure 2:
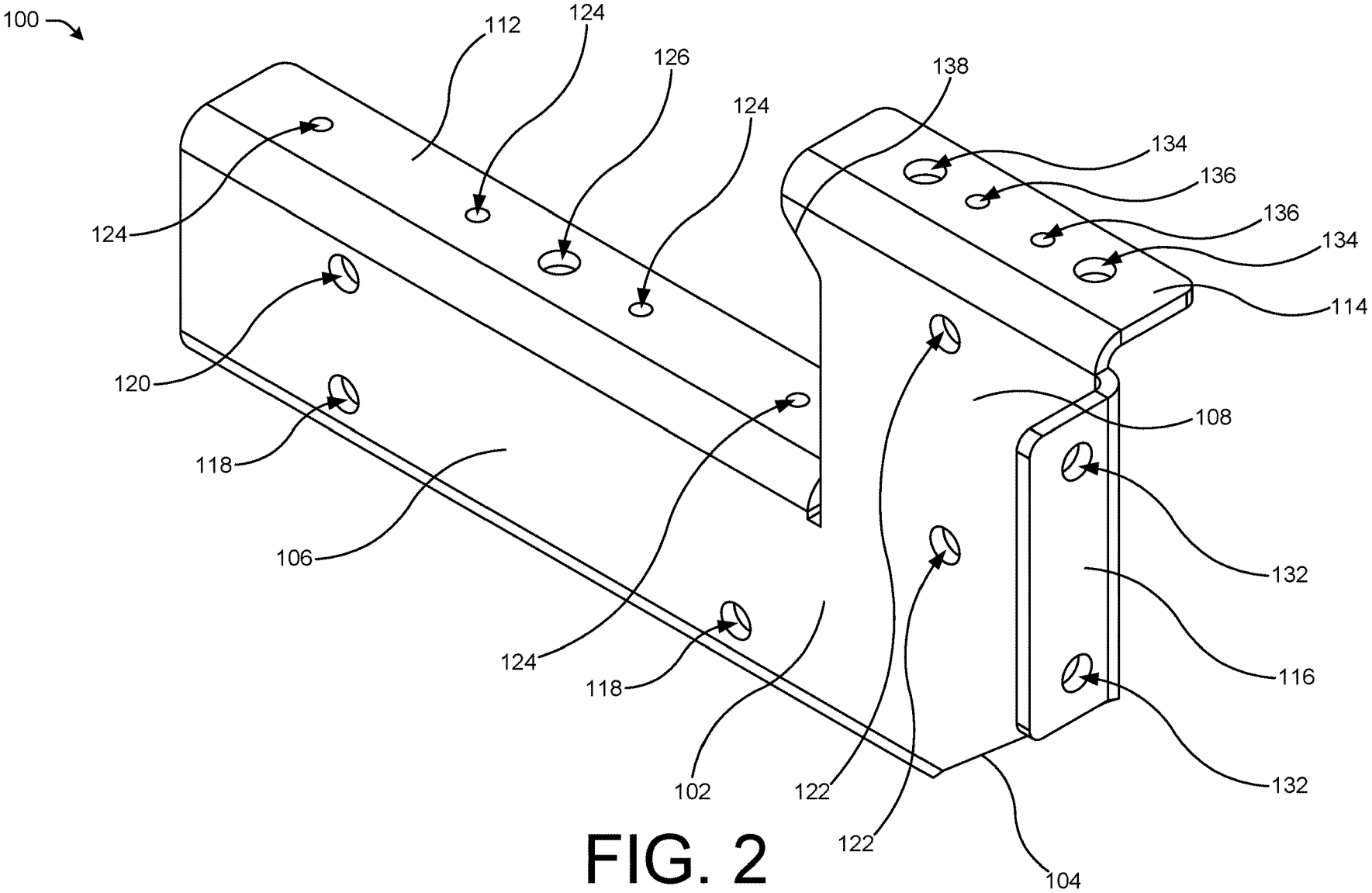
FIG. 2 illustrates a top second perspective view of the right stair stringer of FIG. 1, according to an example of the principles described herein.
Figure 3:
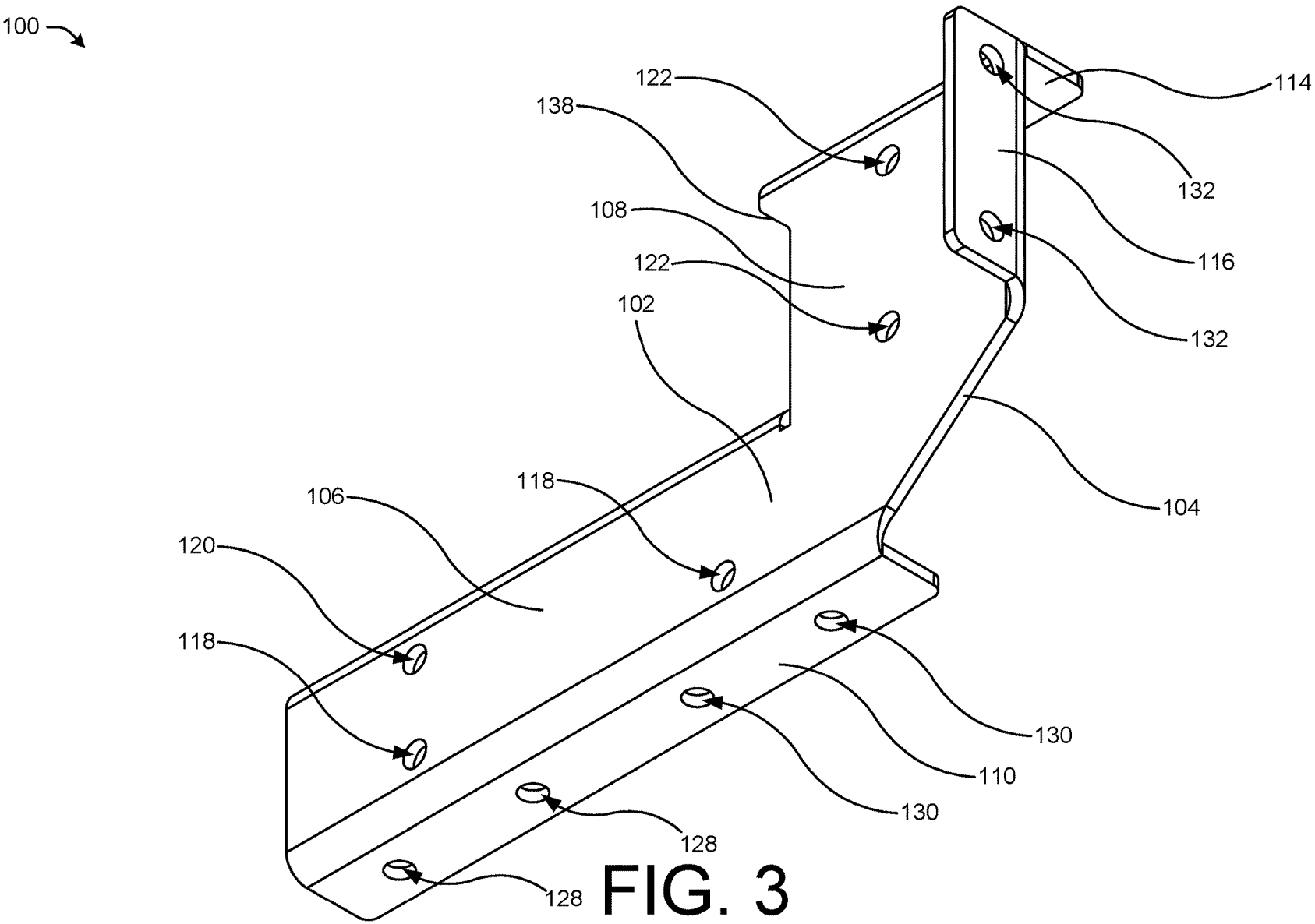
FIG. 3 illustrates a bottom third perspective view of the right stair stringer of FIG. 1, according to an example of the principles described herein.
Figure 4:
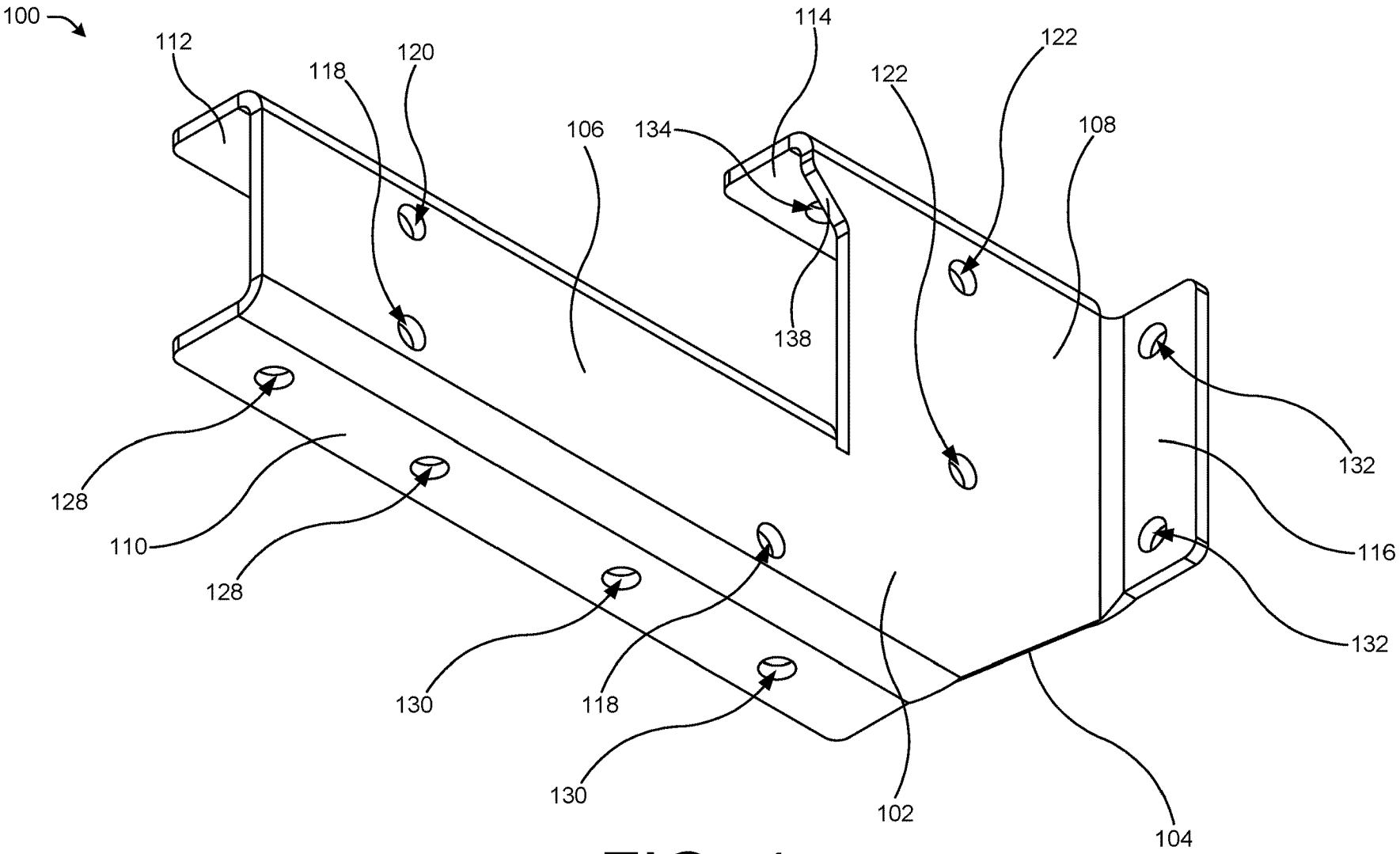
FIG. 4 illustrates a bottom fourth perspective view of the right stair stringer of FIG. 1, according to an example of the principles described herein.
Figure 5:
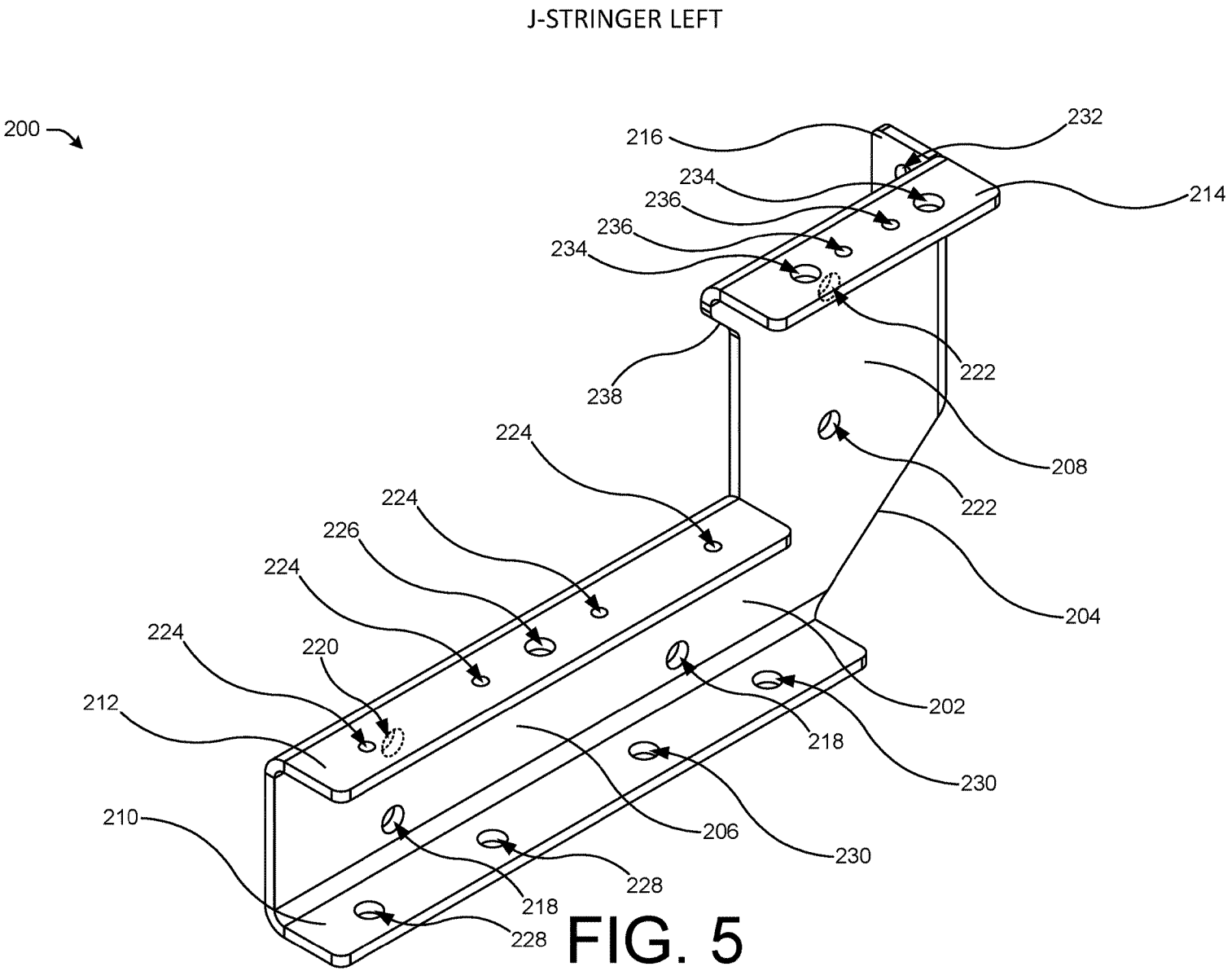
FIG. 5 illustrates a top first perspective view of a left stair stringer, according to an example of the principles described herein.
Figure 6:
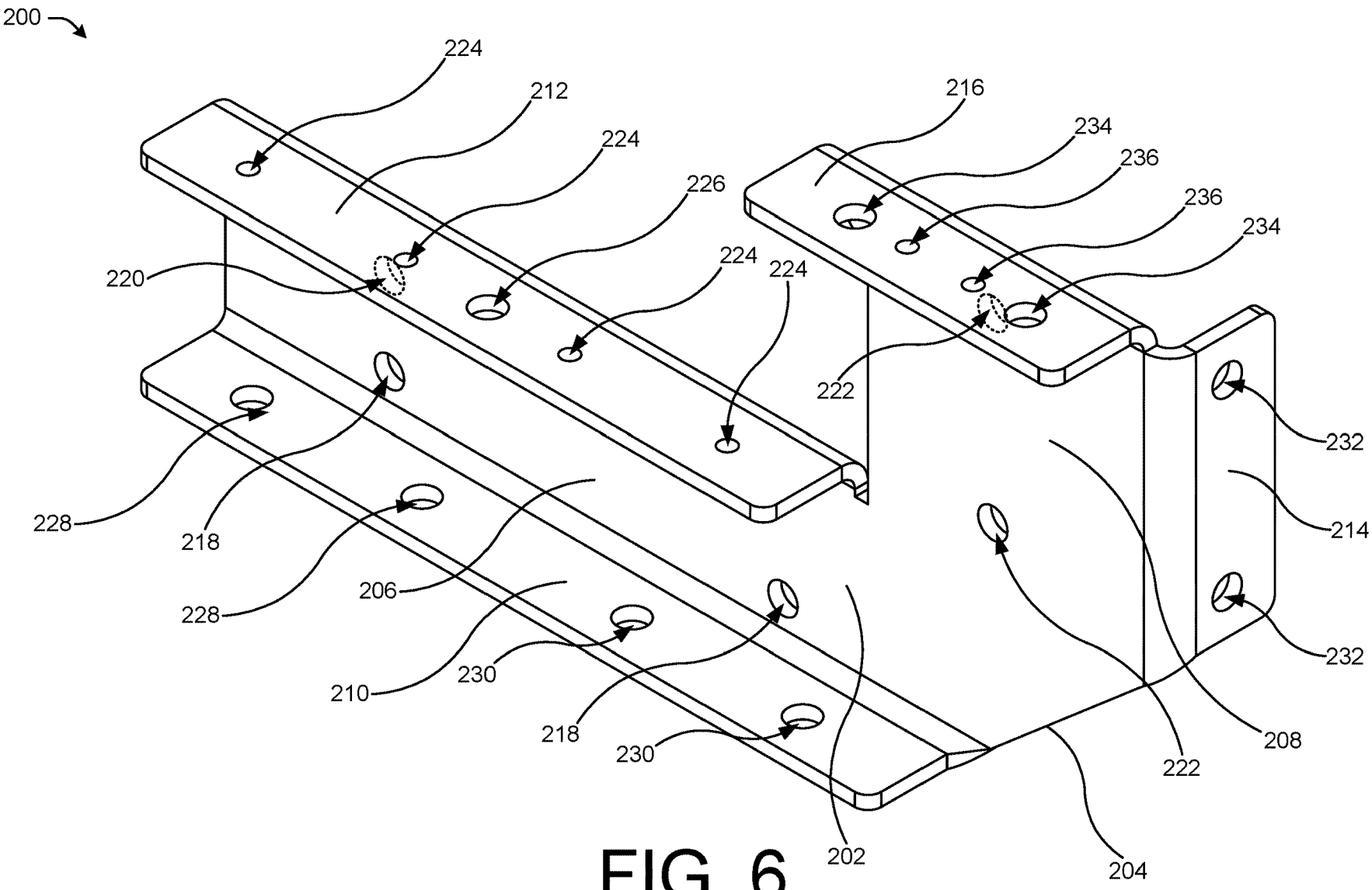
FIG. 6 illustrates a top second perspective view of the left stair stringer of FIG. 5, according to an example of the principles described herein.
Figure 7:
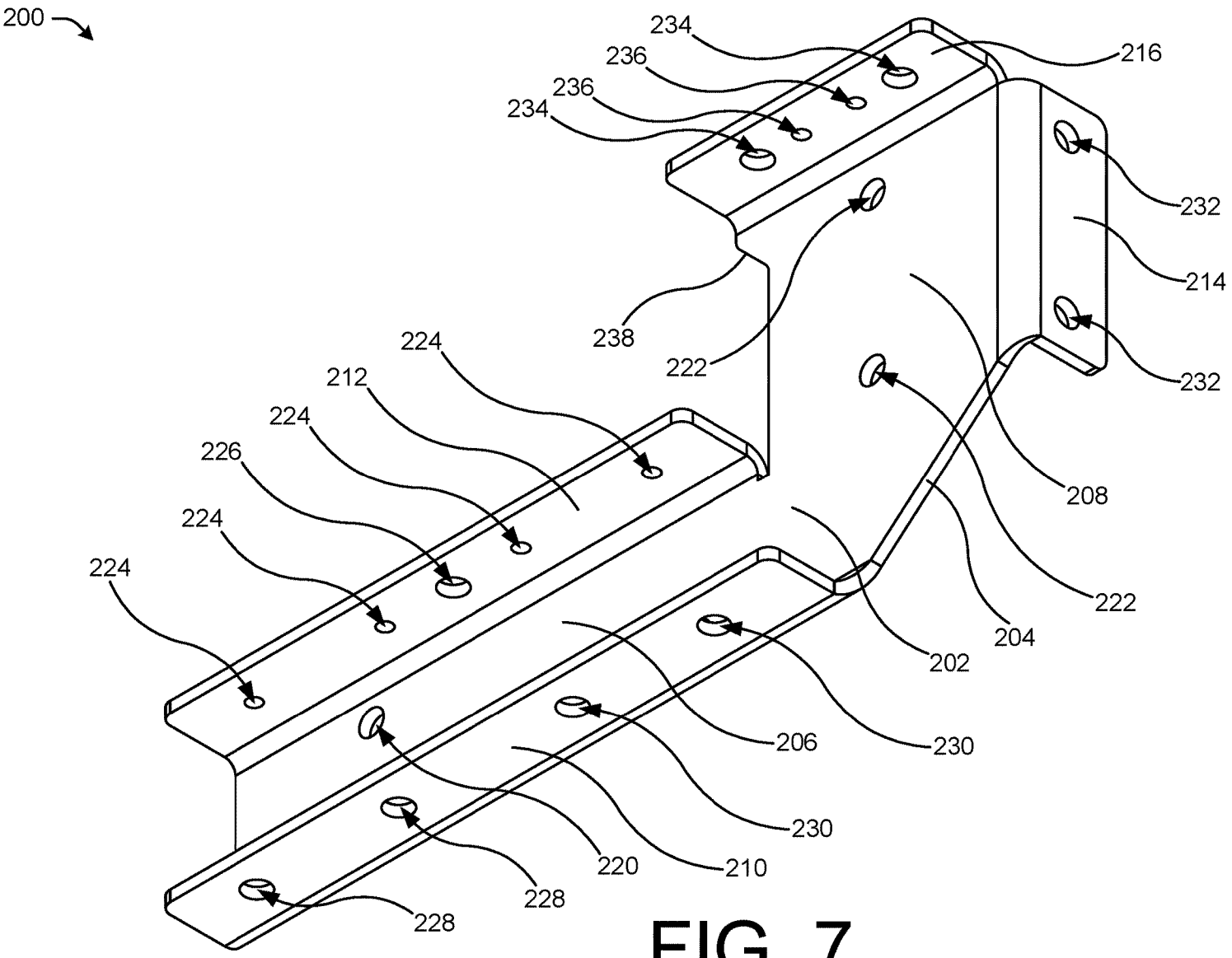
FIG. 7 illustrates a bottom third perspective view of the left stair stringer of FIG. 5, according to an example of the principles described herein.
Figure 8:
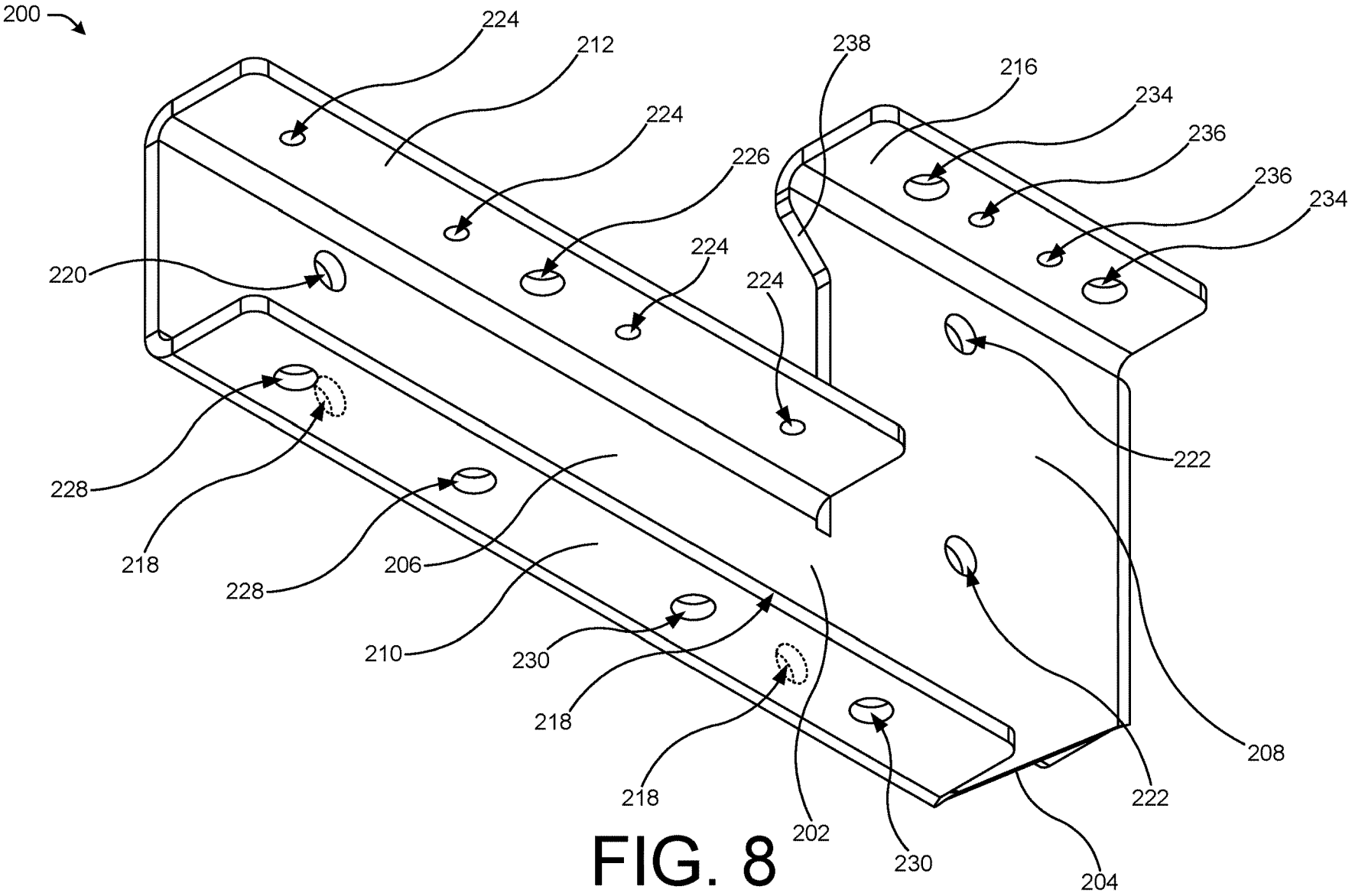
FIG. 8 illustrates a bottom fourth perspective view of the left stair stringer of FIG. 5, according to an example of the principles described herein.

Turning again to the figures, the right stair stringer 100 is depicted in FIGS. 1 through 4. FIG. 1 illustrates a top first perspective view of the right stair stringer 100, according to an example of the principles described herein. FIG. 2 illustrates a top second perspective view of the right stair stringer 100 of FIG. 1, according to an example of the principles described herein. FIG. 3 illustrates a bottom third perspective view of the right stair stringer 100 of FIG. 1, according to an example of the principles described herein. FIG. 4 illustrates a bottom fourth perspective view of the right stair stringer 100 of FIG. 1, according to an example of the principles described herein. The left stair stringer 200 is depicted in FIGS. 5 through 8. FIG. 5 illustrates a top first perspective view of the left stair stringer 200, according to an example of the principles described herein. FIG. 6 illustrates a top second perspective view of the left stair stringer 200 of FIG. 5, according to an example of the principles described herein. FIG. 7 illustrates a bottom third perspective view of the left stair stringer 200 of FIG. 5, according to an example of the principles described herein. FIG. 8 illustrates a bottom fourth perspective view of the left stair stringer 200 of FIG. 5, according to an example of the principles described herein.

With reference to FIGS. 1 through 8, the right stair stringer 100 and the left stair stringer 200 include a body 102, 202. The body 102, 202 includes a center angled portion 104, 204. A horizontal arm 106, 206 extends horizontally from the center angled portion 104, 204. A vertical arm 108, 208 extends vertically from the center angled portion 104, 204. In this manner, the right stair stringer 100 and the left stair stringer 200 have a general "J-shape" or an "L-shape." The angle between the horizontal arm 106, 206 and the vertical arm 108, 208 may be approximately 90 degrees)(° and generally form at least a portion of the run and at least a portion of the rise between two treads within a stairway. Stated another way, the horizontal arm 106, 206 and the vertical arm 108, 208 form the tread and at least a portion of the riser between two treads. As used in the present specification and in the appended claims, the term "tread" is meant to be understood broadly as a part of a stairway that is treaded or walked on. The tread "width" is measured from one side of a tread to the other side of the tread and may define the narrowness of the stairway. As used in the present specification and in the appended claims, the term "riser" is meant to be understood broadly as a vertical portion between each tread on the stair and may be limited to edge portion or missing for an open stair effect as may be case in the present systems where empty space is present between treads and the vertical arms 108, 208 of the right stair stringer 100 and the left stair stringer 200, respectively, are present as the riser.

As used in the present specification and in the appended claims, the term "tread rise" is meant to be understood broadly as a distance from the top of one tread to the top of the next tread. As used in the present specification and in the appended claims, the term "total rise" is meant to be understood broadly as the distance a flight of stairs including the entirety of the stairway raises vertically between a lowest point of the stairway to a highest point of the stairway (e.g., between two floor levels). In an example where the stairway includes N-treads, the total rise equals N times the rise of each tread.

As used in the present specification and in the appended claims, the term "rise height" is meant to be understood broadly as a rise of each tread measured from the top of one tread to the next. In one example, the rise height may not include the physical height of the riser since the physical height of the riser may exclude the thickness of the tread. An individual utilizing the stairway would vertically move an increment of the rise height for each tread taken along the stairway.

As used in the present specification and in the appended claims, the term "tread depth" is meant to be understood broadly as a measurement from the edge of a nosing of a tread to the vertical riser. In examples where the stairway does not include a nosing, the tread depth may equal the going. In one example where the stairway does include a nosing, the tread depth may include the going plus the extent of one nosing. As used in the present specification and in the appended claims, the term "going" is meant to be understood broadly as a measurement from the edge of a first nosing of a first tread to an edge of a nosing in a second tread when viewed in plan view. An individual utilizing the stairway moves the distance of the going with each tread they take. Thus, as used in the present specification and in the appended claims, the terms "total going" of "total run" are meant to be understood broadly as the horizontal distance from the first riser to the last riser. The total going may not simply include the sum of the individual tread lengths due to the nosing overlapping between treads. Thus, in a stairway including N-treads, the total going equals N−1 times the going with the tread of the first tread being part of a landing.

As used in the present specification and in the appended claims, the terms "slope" or "pitch" is meant to be understood broadly as a ratio between the rise and the going (but not the tread depth, due to the nosing). The pitch may be referred to the rake of the stairs. Further, a pitch line may include the imaginary line along the tip of the nosing of the treads.

In light of the above definitions of tread, riser, tread depth, tread width, tread rise, total rise, rise height, nosing, going, total going, pitch, and other definitions provided herein, the right stair stringer 100 and the left stair stringer 200 include a first appendage 110, 210, a second appendage 112, 212, a third appendage 114, 214, and a fourth appendage 116, 216. The first appendage 110, 210, the second appendage 112, 212, and the third appendage 114, 214 are parallel with respect to one another. Further, the fourth appendage 116, 216 is oriented perpendicular to the first appendage 110, 210, the second appendage 112, 212, and the third appendage 114, 214.

The appendages described herein may, in one example, be monolithically formed with the body 102, 202 of the right stair stringer 100 and the left stair stringer 200. For example, the first appendage 110, 210 and the second appendage 112, 212 may be monolithically formed from the horizontal arm 106, 206, and the third appendage 114, 214 and the fourth appendage 116, 216 may be monolithically formed from the vertical arm 108, 208. In this example, the body, the first appendage 110, 210, the second appendage 112, 212, the third appendage 114, 214, and the fourth appendage 116, 216 may be cut from a single piece of material, and the first appendage 110, 210, the second appendage 112, 212, the third appendage 114, 214, and the fourth appendage 116, 216 may be bent approximately perpendicular with respect to a face of the body 102, 202. In one example, the first appendage 110, 210, the second appendage 112, 212, the third appendage 114, 214, and the fourth appendage 116, 216 may be bent at approximately 90° with respect to the face of the body 102, 202. Further, in one example, the bend between the face of the body 102, 202 and the appendages described herein may include a curvature or rounded portion as depicted in FIGS. 1 through 8. In one example, no curvature or rounded portion may exist, and a square interface between the face of the body 102, 202 and the appendages may exist.

In one example, the right stair stringer 100 and the left stair stringer 200 may be cut from a sheet of metal. In this example, the edges of the right stair stringer 100 and the left stair stringer 200 including the extents thereof such as the edges of the appendages and any apertures described herein may be cut. The appendages may then be bent with respect to the body 102, 202 as described above. In one example, the right stair stringer 100 and the left stair stringer 200 may be cut using a laser device, a waterjet cutting device, a plasma cutting device, a shear cutting device, conventional cutting devices, and other cutting devices and methods.

In one example, the right stair stringer 100 and the left stair stringer 200 may be cast as a single piece where the appendages are formed perpendicular to the body 102, 202. In this example, a mold may be created through patternmaking, coremaking, and/or mold making based thereon. Molten metal is poured into the mold, and the right stair stringer 100 and the left stair stringer 200 are cast as a single piece with little or no post-casting processing being performed. In one example, the number of apertures defined in the right stair stringer 100 and the left stair stringer 200 may be cut, drilled, or otherwise removed from the cast of the right stair stringer 100 and left stair stringer 200.

In one example, the appendages may not be formed with the body 102, 202, and may, instead, be formed separately from the body 102, 202 and welded, glued, fastened, or otherwise coupled to the body 102, 202.

The first appendage 110, 210, the second appendage 112, 212, the third appendage 114, 214, and the fourth appendage 116, 216 may include a number of apertures via which the right stair stringer 100 and the left stair stringer 200 are coupled to one another and other elements such as riser spacers, platforms, landings, struts, bases, cross bracings, handrails, vertical handrail stanchions, and other stairway devices and elements, and combinations thereof. Thus, the apertures defined within the first appendage 110, 210, the second appendage 112, 212, the third appendage 114, 214, and the fourth appendage 116, 216 of the right stair stringer 100 and the left stair stringer 200 serve a myriad of functions and may also serve multiple purposes or functions based on the manner in which the right stair stringer 100 and the left stair stringer 200 are utilized within a stairway. The apertures described herein defined within the right stair stringer 100 and the left stair stringer 200 may be formed by creating such voids in a mold in an example where the right stair stringer 100 and the left stair stringer 200 are cast. Further, the apertures described herein defined within the right stair stringer 100 and the left stair stringer 200 may be formed using any subtractive manufacturing process such as, for example, cutting, boring, drilling, and grinding, among other methods of creating the apertures.

The first appendage 110, 210 may extend from a bottom portion of the horizontal arm 106, 206. In one example, the first appendage 110, 210 may extend approximately the length of the horizontal arm 106, 206, may be shorter than the length of the horizontal arm 106, 206, or may extend past the horizontal arm 106, 206 into the center angled portion 104, 204. The first appendage 110, 210 may be used for a plurality of purposes described herein. In order to fulfill its purposes, the first appendage 110, 210 may include a number of apertures including first apertures 128, 228 and second apertures 130, 230. As a first purpose, the first apertures 128, 228 serve to allow for the right stair stringer 100 and the left stair stringer 200 to be coupled to other right stair stringers 100 and left stair stringers 200, respectively, to form a series of stringers 100, 200 and the treads of a stairway. This purpose is achieved by coupling the first appendage 110, 210 of the right stair stringer 100 and the left stair stringer 200 to the third appendage 114, 214 of another right stair stringer 100 and left stair stringer 200, respectively, by extending a fastener through the first apertures 128, 228 and a number of apertures defined in the third appendage 114, 214. An example of this coupling of one stringer 100, 200 with a number of other stringers 100, 200 is depicted in, for example, FIGS. 16 and 17. In this manner, a stairway may be formed.

As a second purpose, the first apertures 128, 228 defined in the right stair stringer 100 and the left stair stringer 200 serve to allow for the right stair stringer 100 and the left stair stringer 200 to be coupled to a base or other foundational element onto which the right stair stringer 100 and the left stair stringer 200 may be seated and/or anchored. An example of the right stair stringer 100 and the left stair stringer 200 being coupled to a base via the first apertures 128, 228 is depicted in, for example, FIGS. 14 through 17. In these examples, bolts or other fasteners from the base may extend through the first aperture 128, 228 and nuts may be used to secure the bolts to the first appendage 110, 210.

Figure 15:
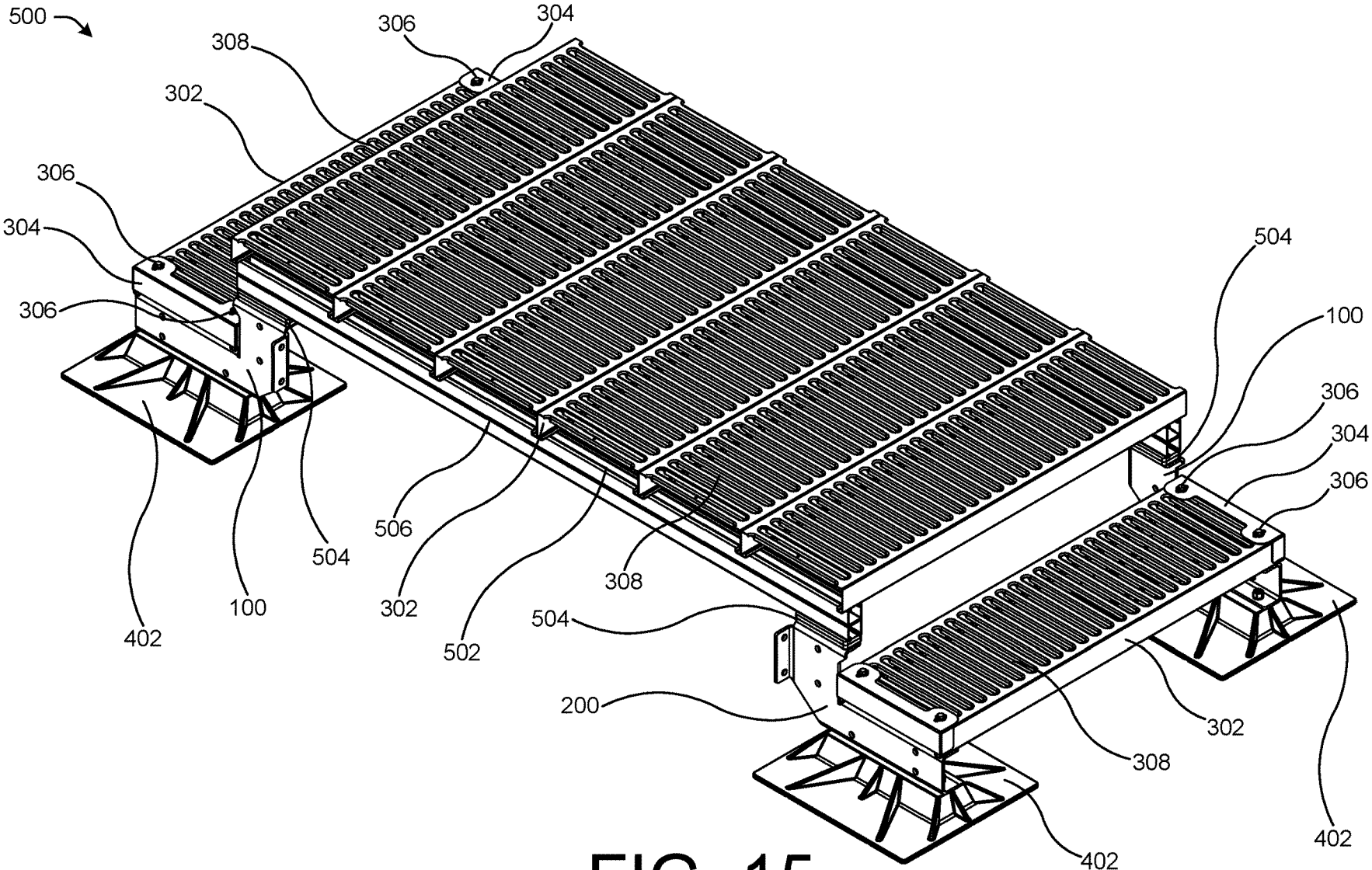
FIG. 15 illustrates a perspective view of a crossover including a number of the treads of FIGS. 9 through 14, and a platform, according to an example of the principles described herein.
Figure 17:
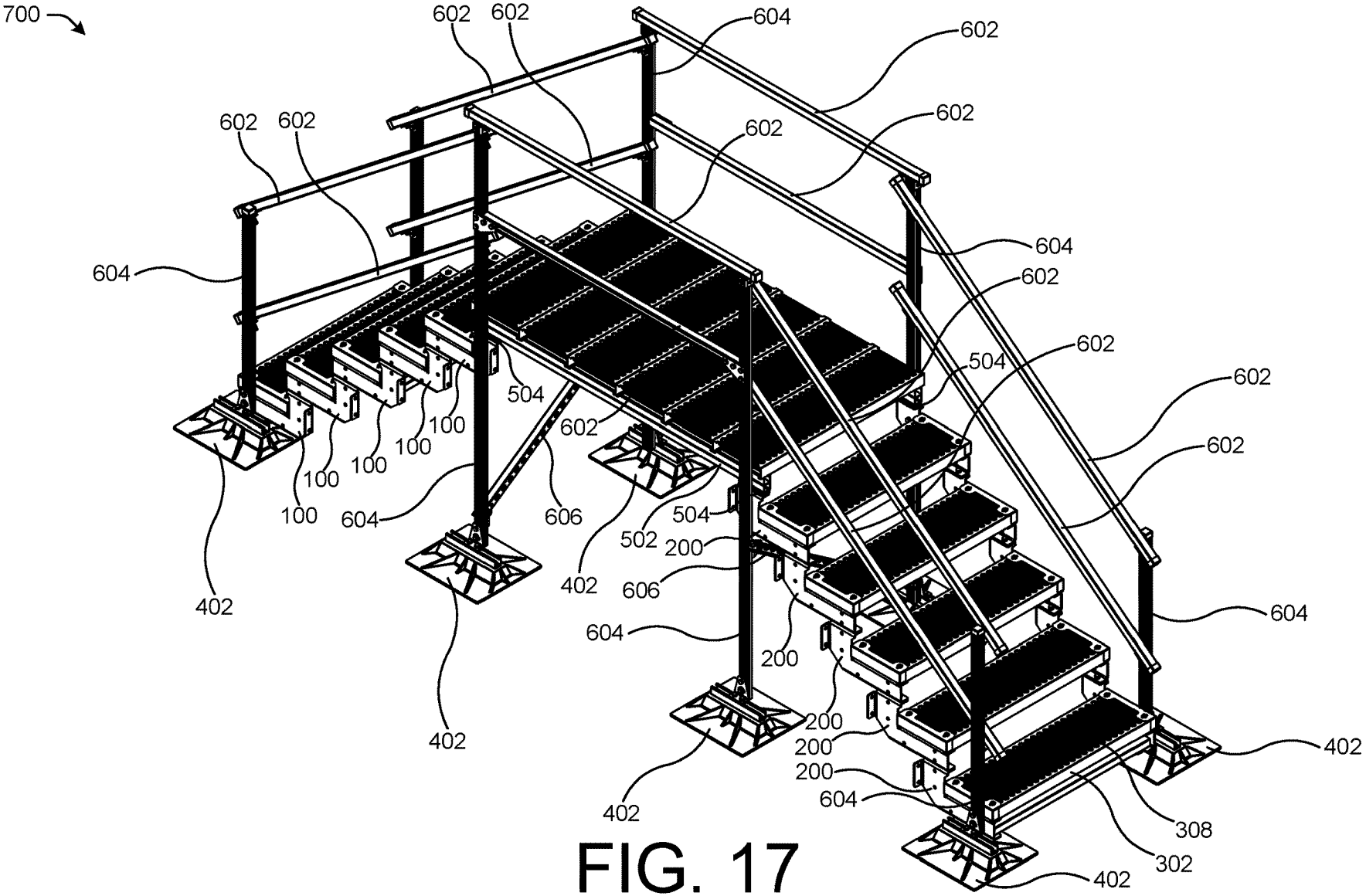
FIG. 17 illustrates a perspective view of a stair assembly including a number of the treads of FIGS. 9-14, according to an example of the principles described herein.
Figure 18:
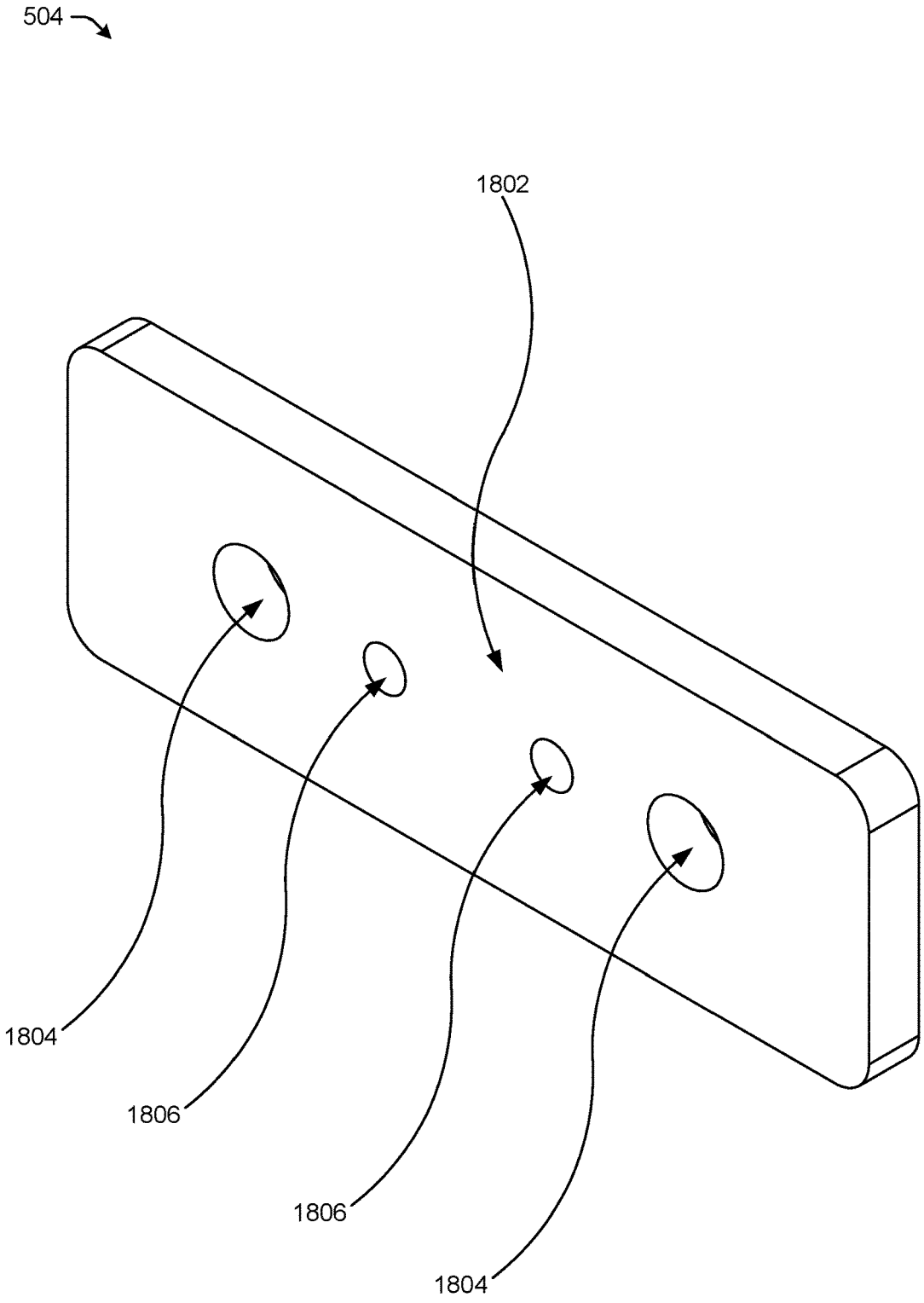
FIG. 18 illustrates a perspective view of a riser spacer that may be included within a stair assembly, according to an example of the principles described herein.

As a third purpose, the first apertures 128, 228 defined in the right stair stringer 100 and the left stair stringer 200 serve to allow for the right stair stringer 100 and the left stair stringer 200 to be coupled to a number of riser spacers (FIG. 15, 504). The riser spacers are depicted in FIGS. 15, 17, and 18. The riser spacers, as will be described in more detail below, may be used to adjust the rise height between treads within the stairway.

As for other purposes for the first apertures 128, 228 being defined in the right stair stringer 100 and the left stair stringer 200, those purposes will be made apparent herein in discussing other figures. It is noted that the other purposes may include, for example, the coupling of the right stair stringer 100 and the left stair stringer 200 to platforms or landings included within the stairway, coupling of the right stair stringer 100 and the left stair stringer 200 to struts, cross braces, handrails, vertical handrail stanchions, and other stairway devices and elements, and combinations thereof.

The first appendage 110, 210 may further include a number of second apertures 130, 230 defined therein. The second apertures 130, 230 may be used for a variety of purposes similar to those described above in connection with the first apertures 128, 228. As a first purpose, the second apertures 130, 230 serve to allow for the right stair stringer 100 and the left stair stringer 200 to be coupled to other right stair stringers 100 and left stair stringers 200, respectively, to form a series of stringers 100, 200 and the treads of a stairway. In this example, the second apertures 130, 230 may be used in addition to or in place of the first apertures 128, 228 where the first appendage 110, 210 of the right stair stringer 100 and the left stair stringer 200 are coupled to the third appendage 114, 214 of another right stair stringer 100 and left stair stringer 200, respectively via a number of fasteners. In one example, the second apertures 130, 230 may be used in place of the first apertures 128, 228 in instances where a relatively larger nosing is desired and/or where a relatively shorter tread depth is desired.

As a second purpose, the second apertures 130, 230 defined in the right stair stringer 100 and the left stair stringer 200 serve to allow for the right stair stringer 100 and the left stair stringer 200 to be coupled to a base or other foundational element onto which the right stair stringer 100 and the left stair stringer 200 may be seated and/or anchored. An example of the right stair stringer 100 and the left stair stringer 200 being coupled to a base via the second apertures 130, 230 is depicted in, for example, FIGS. 14 through 17. In these examples, bolts or other fasteners from the base may extend through the first aperture 128, 228 and nuts may be used to secure the bolts to the first appendage 110, 210.

As a third purpose, the second apertures 130, 230 defined in the first appendage 110, 210 of the right stair stringer 100 and the left stair stringer 200 serve to allow for the right stair stringer 100 and the left stair stringer 200 to be coupled to a number of riser spacers (FIG. 15, 504). The riser spacers are depicted in FIGS. 15, 17, and 18. The riser spacers, as will be described in more detail below, may be used to adjust the rise height between treads within the stairway.

As for other purposes for the second apertures 130, 230 being defined in the right stair stringer 100 and the left stair stringer 200, those purposes will be made apparent herein in discussing other figures. It is noted that the other purposes may include, for example, the coupling of the right stair stringer 100 and the left stair stringer 200 to platforms or landings included within the stairway, coupling of the right stair stringer 100 and the left stair stringer 200 to struts, cross braces, handrails, vertical handrail stanchions, and other stairway devices and elements, and combinations thereof.

The right stair stringer 100 and the left stair stringer 200 may also include a second appendage 112, 212. The second appendage 112, 212 may extend from a top portion of the horizontal arm 106, 206. In one example, the second appendage 112, 212 may extend approximately the length of the horizontal arm 106, 206 or may be shorter than the length of the horizontal arm 106, 206 such that the second appendage 112, 212 terminates at or approximately at the vertical arm 108, 208. The second appendage 112, 212 may be used for a plurality of purposes described herein. In order to fulfill its purposes, the second appendage 112, 212 may include a number of apertures including first apertures 124, 224 and second apertures 126, 226.

As a first purpose, the first apertures 124, 224 serve to allow for the right stair stringer 100 and the left stair stringer 200 to be coupled to a tread (FIGS. 9-17, 302). The tread spans a space between the right stair stringer 100 and the left stair stringer 200 creating a tread that is able to bear an individual's weight and the individual may use within the stairway. As mentioned above, any number of right stair stringers 100 and left stair stringers 200 may be coupled to one another, and, in this example, any number of treads may be coupled to a corresponding number of pairs of right stair stringers 100 and left stair stringers 200 so that any number of treads may be created within the stairway.

Further, the second appendage 112, 212 may include the second apertures 126, 226. The second apertures 126, 226 may also be used to secure a tread to the right stair stringer 100 and the left stair stringer 200. In addition to this use, the second apertures 126, 226 may be used to secure a cross brace between the right stair stringer 100 and the left stair stringer 200 in order to provide further support to the tread and the overall tread.

The right stair stringer 100 and the left stair stringer 200 may also include the third appendage 114, 214. The third appendage 114, 214 may extend from a top portion of the vertical arm 108, 208. In one example, the third appendage 114, 214 may extend approximately the length of the top of the vertical arm 108, 208, may be shorter than the length of the top of vertical arm 108, 208, or may be longer than the top of the vertical arm 108, 208. In one example, the length of the third appendage 114, 214 may extend past the top of the vertical arm 108, 208 and to an extent of the nosing 138 as depicted in FIGS. 1 through 17. The third appendage 114, 214 may be used for a plurality of purposes described herein. In order to fulfill its purposes, the third appendage 114, 214 may include a number of apertures including first apertures 134, 234 and second apertures 136, 236.

As a first purpose, the first apertures 134, 234 serve to allow for the right stair stringer 100 and the left stair stringer 200 to be coupled to other right stair stringers 100 and left stair stringers 200, respectively, to form a series of stringers 100, 200 and the treads of a stairway. This purpose is achieved by coupling the first appendage 110, 210 of the right stair stringer 100 and the left stair stringer 200 to the third appendage 114, 214 of another right stair stringer 100 and left stair stringer 200, respectively as described above in connection with the first appendage 110, 210. In one example, the first apertures 128, 228 of the first appendage 110, 210 may align with the first apertures 134, 234 of the third appendage 114, 214 to allow for a fastener to be extended through the first apertures 128, 228 of the first appendage 110, 210 and the first apertures 134, 234 of the third appendage 114, 214 to secure the series of stringers 100, 200 to one another. Further, in one example, a number of riser spacers (FIG. 15, 504) may be disposed between the first appendage 110, 210 and the third appendage 114, 214 and secured therebetween in order to adjust the rise height between treads within the stairway. Still further, when two stringers 100, 200 are coupled together, a vertical distance between the second appendage 112, 212 of a first stair stringer 100, 200 and the second appendage 112, 212 of a second stair stringer 100, 200 coupled to the first stair stringer 100, 200 defines a rise height between two treads of a stairway. An example of this coupling of one stringer 100, 200 with a number of other stringers 100, 200 is depicted in, for example, FIGS. 16 and 17. In this manner, a stairway may be formed.

Further, the third appendage 114, 214 may include the second apertures 136, 236. The second apertures 136, 236 may also be used to secure a number of the riser spacers (FIG. 15, 504) between neighboring right stair stringers 100 and left stair stringers 200.

The right stair stringer 100 and the left stair stringer 200 may also include the fourth appendage 116, 216. The fourth appendage 116, 216 may extend from a side of the vertical arm 108, 208. In one example, the fourth appendage 116, 216 may extend approximately the length of the side of the vertical arm 108, 208, may be shorter than the length of the side of vertical arm 108, 208, or may be longer than the side of the vertical arm 108, 208. In one example, the length of the fourth appendage 116, 216 may extend from the top of the vertical arm 108, 208, along the side of the vertical arm 108, 208, and to or approximately to the top of the center angled portion 104. The fourth appendage 116, 216 may be used for a plurality of purposes described herein. In order to fulfill its purposes, the fourth appendage 116, 216 may include a number of apertures including first apertures 132, 232.

As a first purpose, the first apertures 132, 232 defined in the fourth appendage 116, 216 serve to allow for the right stair stringer 100 and the left stair stringer 200 to be coupled to a wall or similar vertical portion of the structure at which the stairway is to be installed. For example, a rooftop door may be elevated above the level of a rooftop, and a stairway may be utilized to bridge the vertical gap between the raised rooftop door and the rooftop. In this example, a number of fasteners such as, for example, lag screws, may be extended through the first apertures 132, 232 and into the wall portion of the structure below the threshold of the rooftop door. In this manner, the structural support of the wall of the structure may be utilized to support the stairway.

Additionally, as a second purpose, the first apertures 132, 232 defined in the fourth appendage 116, 216 may serve as a means by which the vertical handrail stanchions (FIGS. 16 and 17, 604) may be coupled to the right stair stringer 100 and the left stair stringer 200. The vertical handrail stanchions may be coupled to the surface of the rooftop directly, or may be coupled to the surface of the rooftop indirectly via a base as depicted in, for example, FIGS. 16 and 17. Thus, when the right stair stringer 100 and the left stair stringer 200 are coupled to the vertical handrail stanchions by extending a number of fasteners through the first apertures 132, 232 and into or in coupling interface with the vertical handrail stanchions, the structural support of the vertical handrail stanchions may be utilized to support the stairway.

Figure 16:
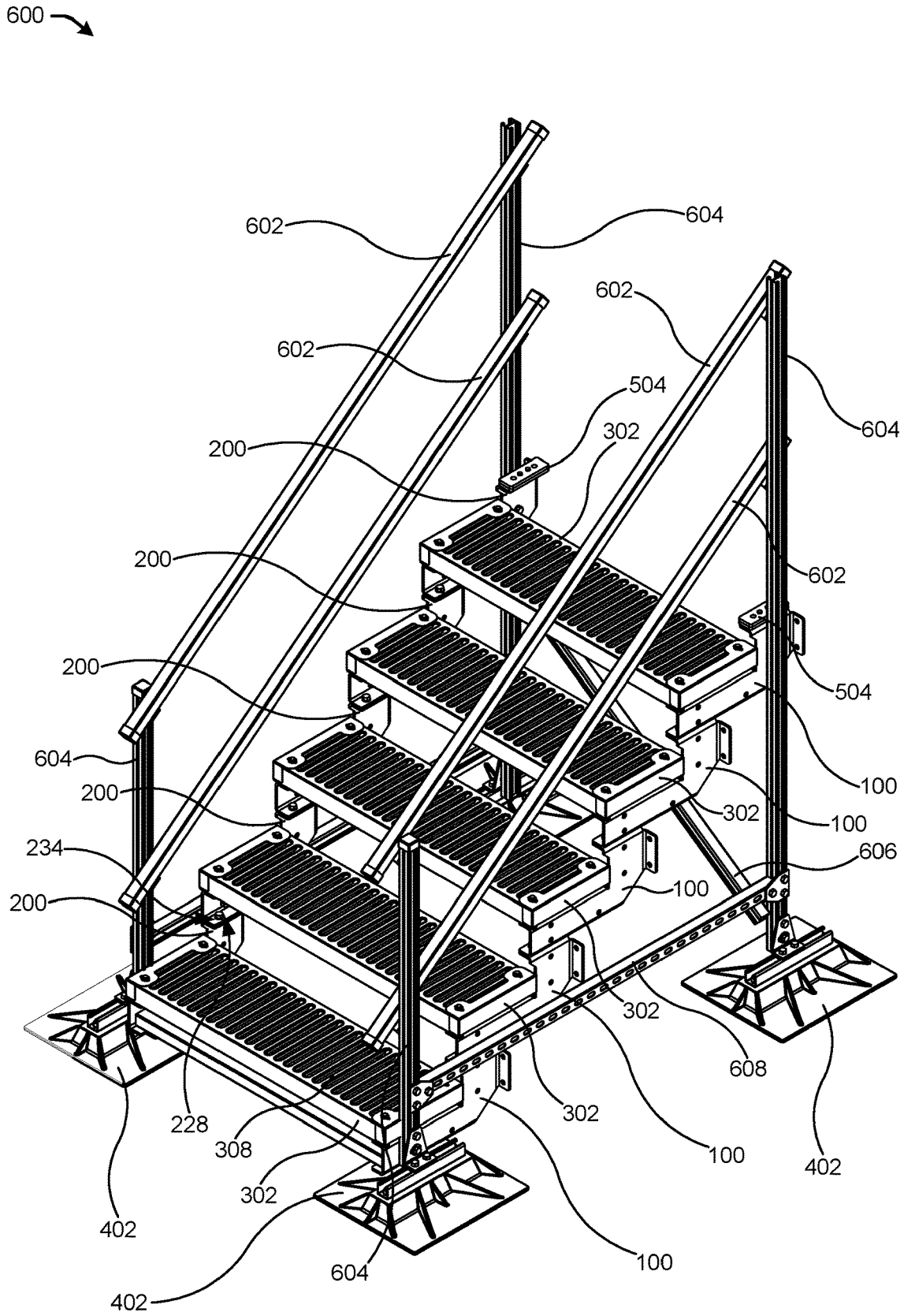
FIG. 16 illustrates a perspective view of a stair assembly including a number of the treads of FIGS. 9-14, according to an example of the principles described herein.

Further, as a third purpose, the first apertures 132, 232 may serve as an anchor to which a number of cross braces may be coupled. In this example, a number of cross braces may be coupled directly or indirectly to the right stair stringer 100 and the left stair stringer 200 via the first apertures 132, 232. For example, as depicted in FIGS. 16 and 17, the cross braces 606 may be coupled to the vertical handrail stanchions 604 and indirectly coupled to the fourth appendage 116, 216 via the first apertures 132, 232. In one example, the cross braces 606 may be directly coupled to the fourth appendage 116, 216 via the first apertures 132, 232.

The right stair stringer 100 and the left stair stringer 200 may also include a number of apertures defined in the body 102, 202 that also serve a number of purposes or functions. For example, first apertures 118, 218 may be defined in the horizontal arm 106, 206 of the body 102, 202. In one example, the first apertures 118, 218 may be used to couple the vertical handrail stanchions (FIGS. 16 and 17, 604) to the right stair stringer 100 and the left stair stringer 200 by extending a fastener through the first apertures 118, 218 and into or in coupling interface with the vertical handrail stanchions.

The first apertures 118, 218 may, in one example, also be used to couple a support strut to, for example, a number of vertical handrail stanchions and the stairway. In this example, the support strut may be coupled at least one of the right stair stringer 100 and/or the left stair stringer 200 and/or to the vertical handrail stanchions to further support the stairway by bridging and relying on the vertical handrail stanchions as supports with respect to the rooftop surface and coupling the at least one of the right stair stringer 100 and/or the left stair stringer 200 indirectly to the vertical handrail stanchions.

In another example, the first apertures 118, 218 defined in the body 102, 202 of the right stair stringer 100 and the left stair stringer 200 may be used to support the stairway via a shipping support coupled thereto. In examples where a stairway is shipped in an assembled state, a shipping support may be coupled to the right stair stringer 100 and/or the left stair stringer 200 via the first apertures 118, 218. In this example, a number of fasteners may be extended through the first apertures 118, 218 and into or in coupling interface with the shipping support. After the stairway is installed on the rooftop, the shipping support may be removed, or may be retained as a support that acts in a similar manner as described above in connection with the support strut.

A number of second apertures 120, 220 may also be defined in the horizontal arm 106, 206 of the body 102, 202 of the right stair stringer 100 and the left stair stringer 200. The second apertures 120, 220 may, in one example, be used to couple a vertical handrail stanchion to the right stair stringer 100 and the left stair stringer 200. In this example, the vertical handrail stanchions may be coupled at least one of the right stair stringer 100 and/or the left stair stringer 200, and the vertical handrail stanchions may be coupled to a base 402 to further provide support to the right stair stringer 100 and/or the left stair stringer 200 as depicted in, for example, FIGS. 16 and 17.

The second apertures 120, 220 may, in one example, also be used to couple a number of railings to the right stair stringer 100 and/or the left stair stringer 200. In this example, the railings may be directly coupled to at least one of the right stair stringer 100 and/or the left stair stringer 200 via fasteners extended through the second apertures 120, 220 and into or in coupling interface with the railings. In one example, the railings may be indirectly coupled to at least one of the right stair stringer 100 and/or the left stair stringer 200 via the vertical handrail stanchions. In this example, the railings may be coupled to the vertical handrail stanchions, and the vertical handrail stanchions may be coupled to a base 402 to further provide support to the right stair stringer 100 and/or the left stair stringer 200 as depicted in, for example, FIGS. 16 and 17.

A number of third apertures 122, 222 may also be defined in the vertical arm 108, 208 of the body 102, 202 of the right stair stringer 100 and/or the left stair stringer 200. In one example, the third apertures 122, 222 may be used to couple a vertical handrail stanchion to the right stair stringer 100 and/or the left stair stringer 200 and/or railings as described herein. In one example, the third apertures 122, 222 may be used to couple the vertical handrail stanchion and/or the railings directly or indirectly to the right stair stringer 100 and/or the left stair stringer 200 as described herein.

As described above, the various apertures defined in the right stair stringer 100 and/or the left stair stringer 200 including in the body 102, 202 including the center angled portion 104, 204, the horizontal arm 106, and/or the vertical arm 108, 208, and the first appendage 110, 210, the second appendage 112, 212, the third appendage 114, 214, and/or the fourth appendage 116, 216 may be used for a myriad of purposes. As described herein, those purposes include, for example, coupling a number of the right stair stringer 100 and/or the left stair stringer 200 to one another to form a series of right stair stringers 100 and a series of left stair stringers 200 opposite the series of right stair stringers 100 as depicted in, for example, FIGS. 16 and 17. Further, the purposes of the various apertures may also include coupling a number of treads to the series of right stair stringers 100 and the series of left stair stringers 200 such that the number of treads are coupled between the series of right stair stringers 100 and the series of left stair stringers 200 to form a stairway.

Further, the purposes of the various apertures may also include coupling riser spacers, platforms, landings, struts, bases, cross bracings, handrails, vertical handrail stanchions, and other stairway devices and elements, and combinations thereof to the right stair stringers 100 and/or the left stair stringers 200. These additional elements, when coupled to the right stair stringers 100 and/or the left stair stringers 200 via the apertures, may provide safety to an individual as they climb or otherwise utilize the stairway created using the right stair stringers 100 and the series of left stair stringers 200. Further, these additional elements, when coupled to the right stair stringers 100 and/or the left stair stringers 200 via the apertures, may provide support to the stairway by anchoring and securing the stairway to a surface of the rooftop, walls, and other architectural features of the structure on which the stairway is installed. Still further, these additional elements, when coupled to the right stair stringers 100 and/or the left stair stringers 200 via the apertures, may assist in providing support for shipping an assembled stairway to the rooftop of the structure.

The right stair stringer 100 of FIGS. 1 through 4 and the left stair stringer 200 of FIGS. 5 through 8 include a nosing 138, 238. The nosing allows for a first tread (FIGS. 9 through 17, 302) coupled to the second appendage 112, 212 of a first right stair stringer 100 and left stair stringer 200 pair to overlap with a second tread 302 coupled to the second appendage 112, 212 of a neighboring right stair stringer 100 and left stair stringer 200 pair. As used in the present specification and in the appended claims, the term "nosing" is meant to be understood broadly as any edge part of the tread or tread that protrudes over the riser beneath. In an example where the nosing 138, 238 is present, when measured horizontally, the total run length of the stairs is not the sum of the tread lengths since the treads, in this example overlap each other due to the nosing. In some instances, building codes may require stair nosings for commercial, industrial, or municipal stairs. The nosings 138, 238 provide additional length to the tread without changing the pitch of the stairs.

The dimensions of the various elements of the right stair stringer 100 and the left stair stringer 200 including in the body 102, 202 including the center angled portion 104, 204, the horizontal arm 106, and/or the vertical arm 108, 208, and the first appendage 110, 210, the second appendage 112, 212, the third appendage 114, 214, and/or the fourth appendage 116, 216 may be based on at least one building code or convention. For example, the rise height, the tread depth, the going, the total run, the total rise, the pitch, and other dimensions of the stairway may be defined, at least in part, by the dimensions of the features and elements of the right stair stringer 100 and the left stair stringer 200, and the dimensions of the features and elements may, in turn, be defined by the at least one building code or convention.

Having described the various features and elements of the right stair stringer 100 and the left stair stringer 200, the use of the right stair stringer 100 and the left stair stringer 200 in various situations and installations will now be described in connection with FIGS. 9 through 18. Specifically, FIGS. 9 through 13 depict a single step that includes a tread and the right stair stringer 100 and the left stair stringer 200.

Figure 9:
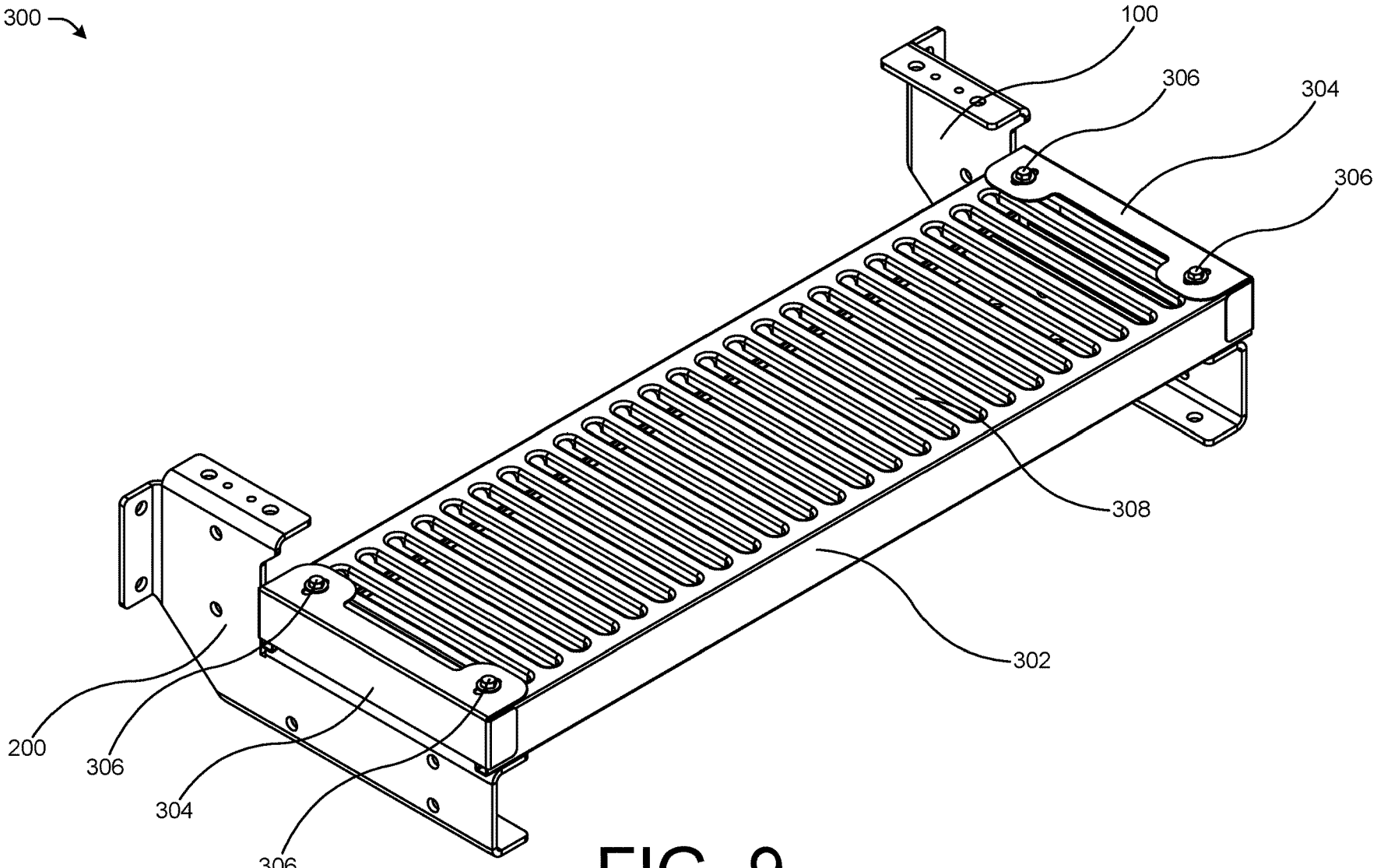
FIG. 9 illustrates a top first perspective view of a tread including the right stair stringer of FIGS. 1 through 4 and the left stair stringer of FIGS. 5 through 8, according to an example of the principles described herein.
Figure 10:
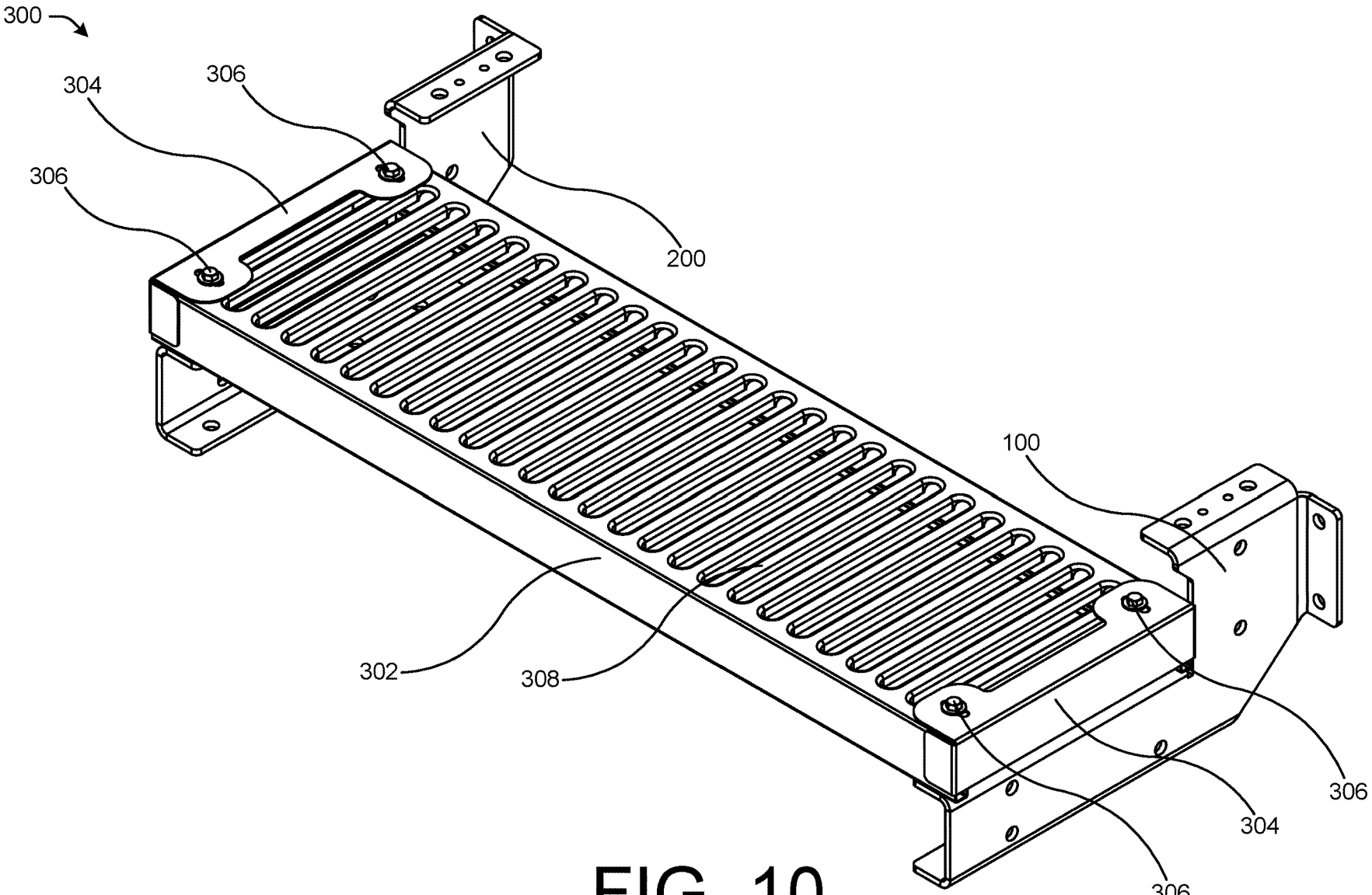
FIG. 10 illustrates a top second perspective view of the tread of FIG. 10, according to an example of the principles described herein.
Figure 11:
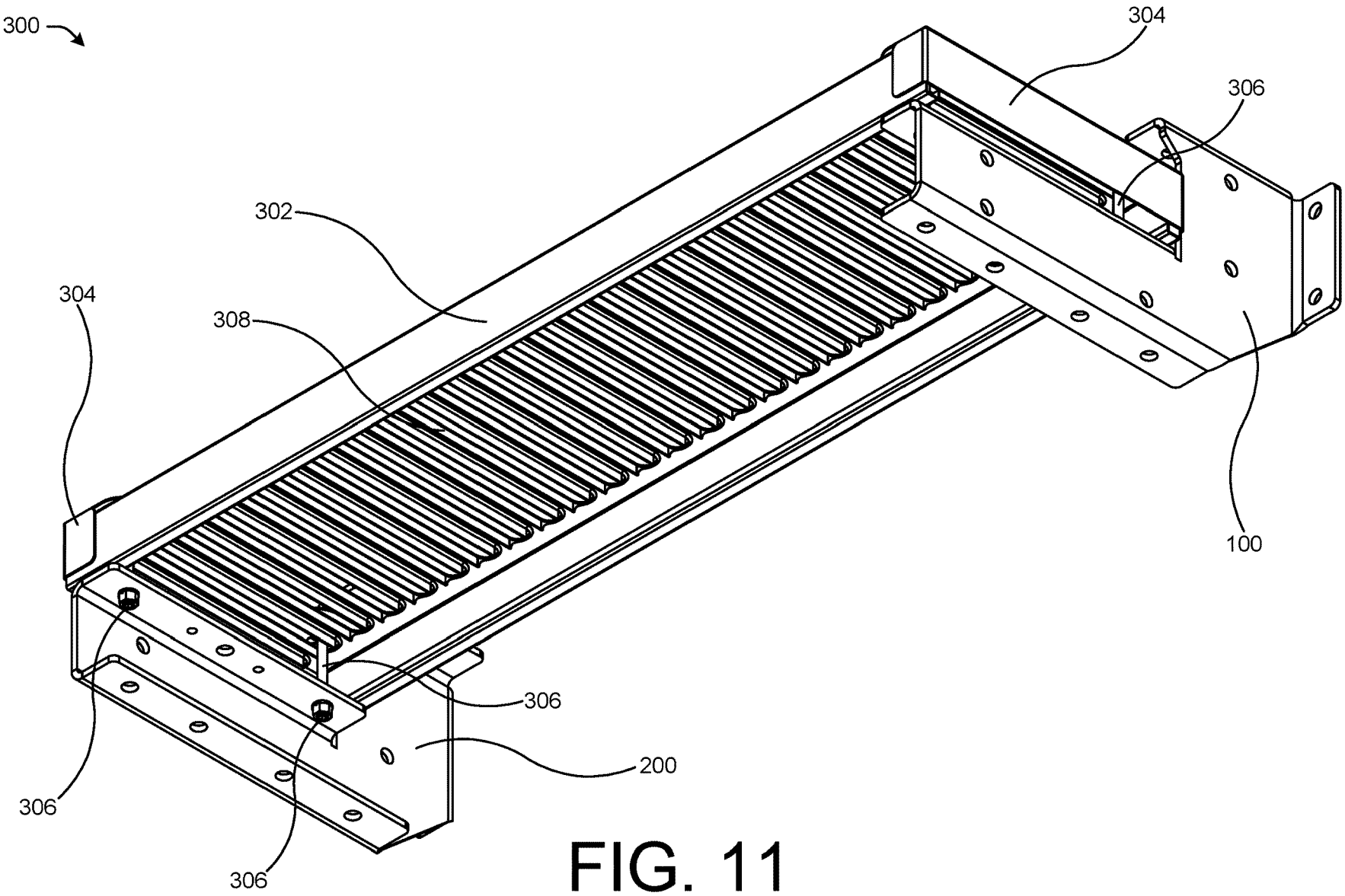
FIG. 11 illustrates a bottom third perspective view of the tread of FIG. 10, according to an example of the principles described herein.
Figure 12:
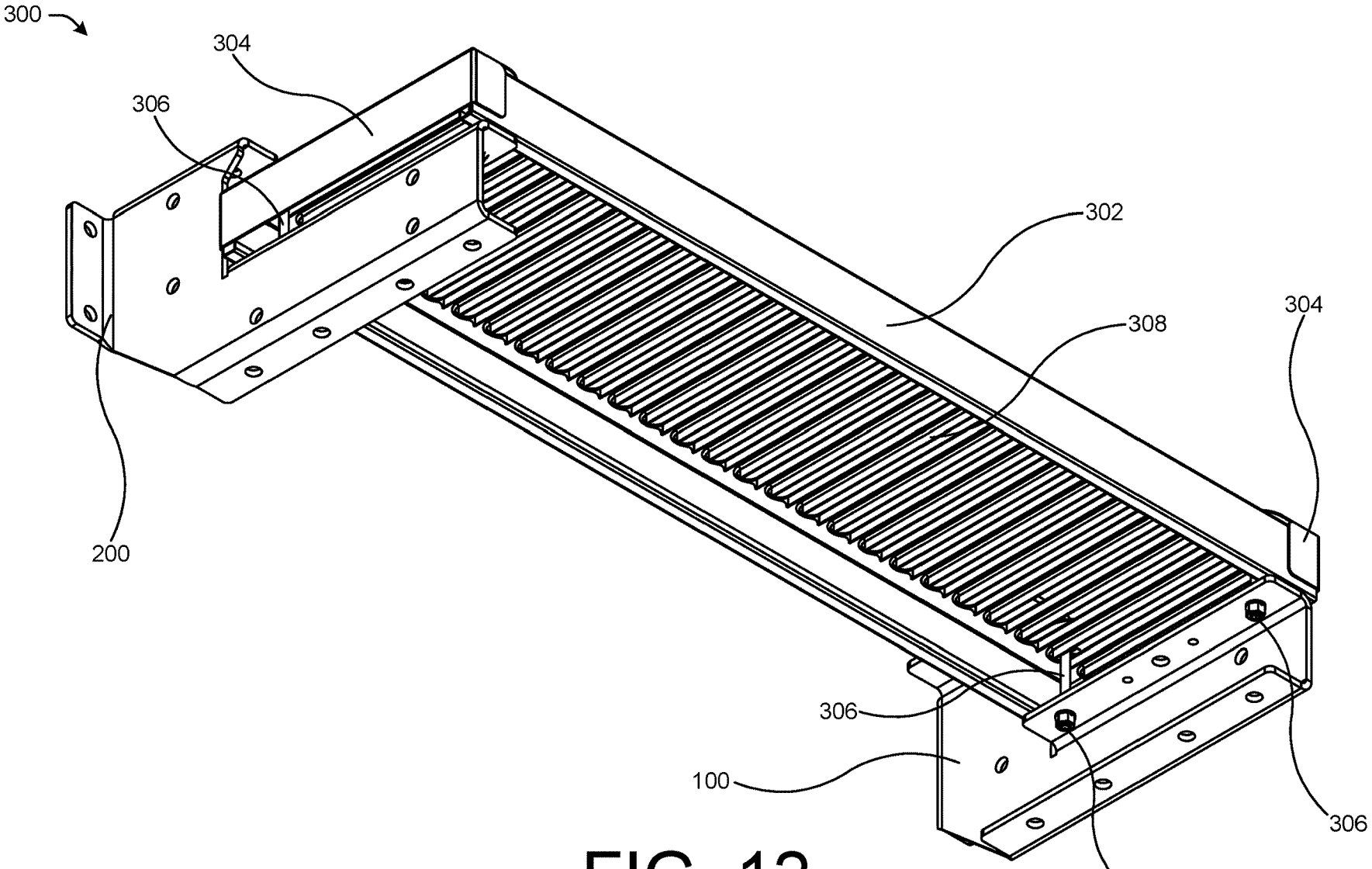
FIG. 12 illustrates a bottom fourth perspective view of the tread of FIG. 10, according to an example of the principles described herein.
Figure 13:
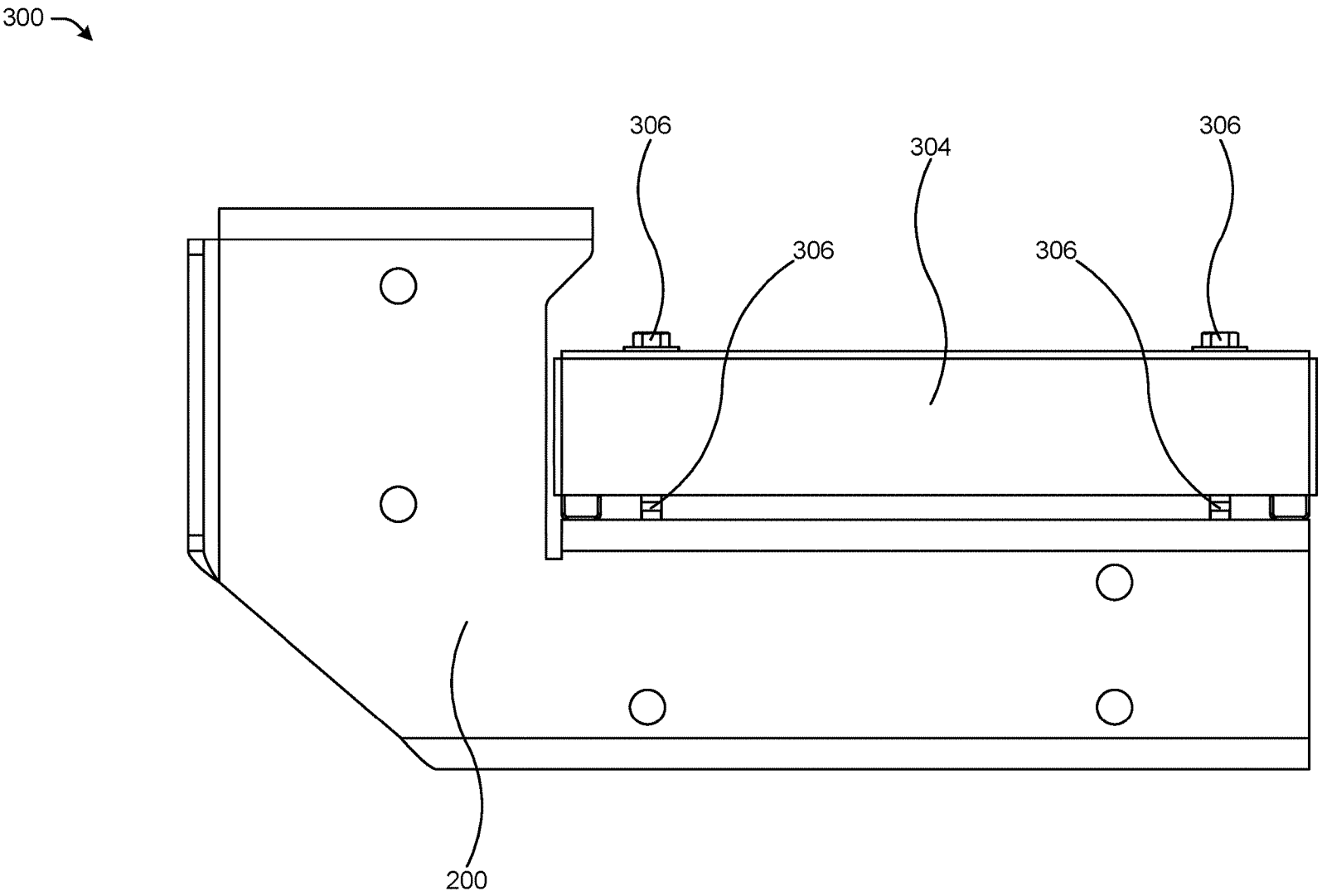
FIG. 13 illustrates a side view of the tread of FIG. 10, according to an example of the principles described herein.

FIG. 9 illustrates a top first perspective view of a tread 302 including the right stair stringer 100 of FIGS. 1 through 4 and the left stair stringer 200 of FIGS. 5 through 8, according to an example of the principles described herein. FIG. 10 illustrates a top second perspective view of the tread 302 of FIG. 10, according to an example of the principles described herein. FIG. 11 illustrates a bottom third perspective view of the tread 302 of FIG. 10, according to an example of the principles described herein. FIG. 12 illustrates a bottom fourth perspective view of the tread 302 of FIG. 10, according to an example of the principles described herein. FIG. 13 illustrates a side view of the tread 302 of FIG. 10, according to an example of the principles described herein. The combination of the right stair stringer 100 and the left stair stringer 200 along with the tread 302 form a simplest type of stairway. A stairway as described herein includes at least one step including the tread 302 and the right stair stringer 100 and the left stair stringer 200. However, as described herein, any number of treads 302 may be included in a stairway. The assembly of the tread 302 and the right stair stringer 100 and the left stair stringer 200 may be referred to herein as a step 300.

As depicted in FIGS. 9 through 13, the right stair stringer 100 and the left stair stringer 200 may be coupled together via a tread 302. The tread 302 may be coupled to the right stair stringer 100 and the left stair stringer 200 via a number of fasteners 306. In one example, the fasteners 306 may include a number of bolts extending through the tread 302 and into the first apertures 124, 224 and/or the second apertures 126, 226 of the second appendage 112, 212. Nuts may be used to secure the bolts, and, thereby, securing the tread 302 to the right stair stringer 100 and the left stair stringer 200. In one example, the tread 302 may be coupled to the right stair stringer 100 and the left stair stringer 200 via any other methods or devices including welding, gluing, clamping, or via screws, nails, rivets, lynch pins, cotter pins, locking pins, clevis pins, other fasteners and fastening methods, and combinations thereof. Once coupled to the right stair stringer 100 and the left stair stringer 200, the tread 302 may bear the weight of one or more individuals. In the examples described herein, once a step and/or a stairway is constructed, they may be secured to one or more architectural features of the structure to which they are installed including, for example, a surface of the rooftop, a wall, or other architectural feature.

The treads 302 may include, in one example, end caps 304. The end caps 304 may serve to cap the ends of the tread 302 in order to avoid any sharp edges that may be created at the ends of the treads 302 as well as to assist in reduction or elimination of the ends of the tread 302 being subjected to oxidation through direct exposure to precipitation. Still further, the end caps 304 may be used to finish the tread 302 and place trademark or other indicia thereon. In one example, the fasteners used to couple the tread 302 to the right stair stringer 100 and the left stair stringer 200 may also be used to couple the end caps 304 to the tread 302 by extending the fastener through holes defined in the end caps 304 that vertically align with the first apertures 124, 224 and/or the second apertures 126, 226 of the second appendage 112, 212.

In one example, the tread 302 may include a top surface 308. The top surface 308 as depicted in FIGS. 8 through 17 includes a grate to allow for precipitation including, for example, rain and snow, to drop through the tread 302 and to a surface underneath the step 300 and/or the stairway. In one example, the top surface 308 may include any type of texturing, knurling, or similar slip resistant surface so that a risk of an individual slipping on the surface of the top surface 308. Thus, the tread 302 as described herein is fit to be placed outdoors including on, for example, a surface of a roof where precipitation may fall on the tread 302 and the stairway without being subjected to significant deterioration through oxidation processes and remaining in a state where it may not be risky for an individual to use the stairway.

Figure 14:
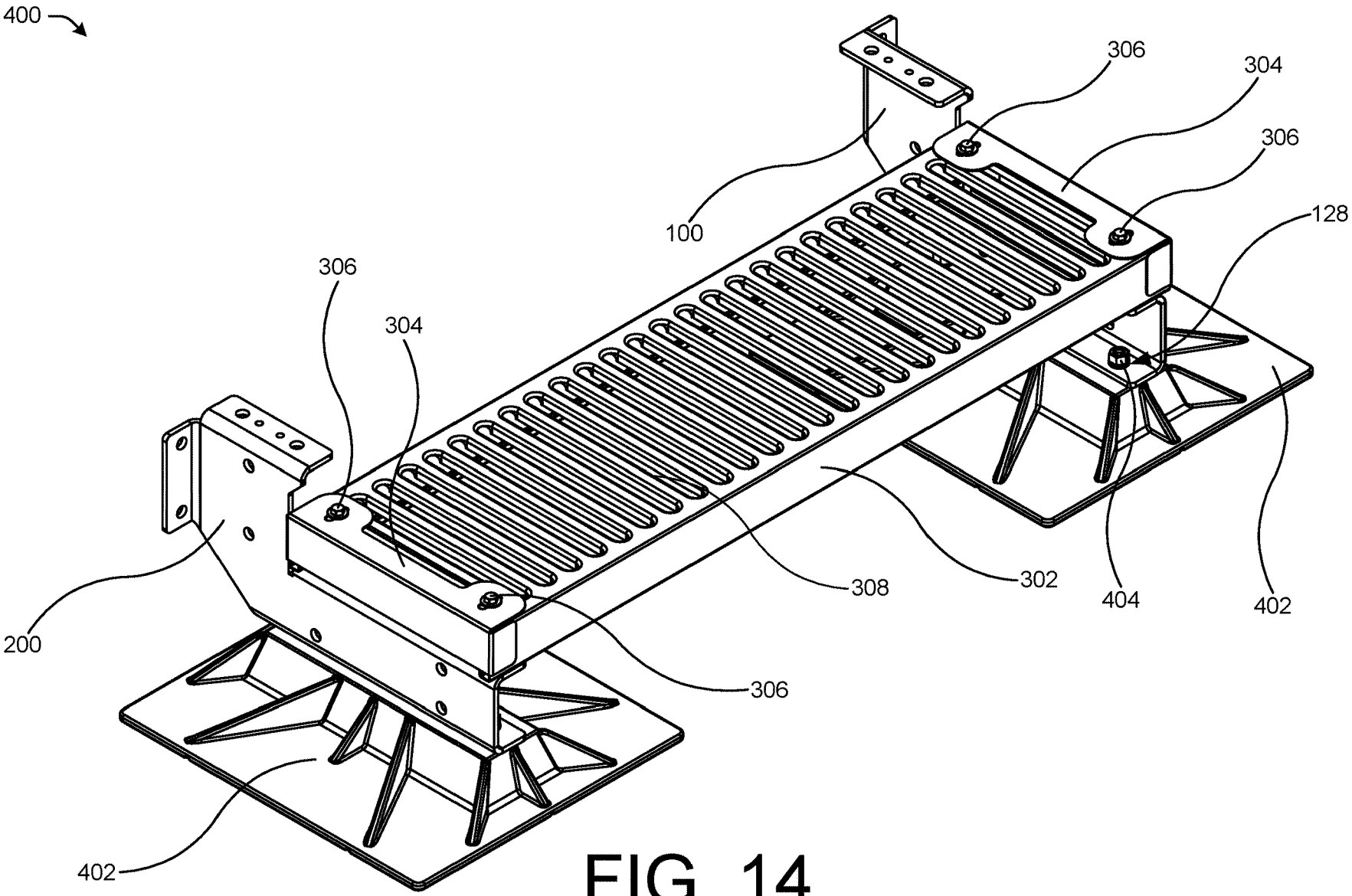
FIG. 14 illustrates a perspective view of the tread of FIG. 10 including a number of bases, according to an example of the principles described herein.

FIG. 14 illustrates a perspective view of the tread 302 of FIG. 10 including a number of bases 402, according to an example of the principles described herein. The assembly depicted in FIG. 14 may be referred to as a base-supported step 400. The tread 302 and the right stair stringer 100 and the left stair stringer 200 may be directly coupled to a surface such as the surface of a rooftop. However, in the example of FIG. 14, a number of bases 402 may be coupled to the first appendages 110, 210 of the right stair stringer 100 and the left stair stringer 200. The bases 402 may be coupled to the first appendages 110, 210 using any type of fastener or method of fastening including, for example, a nut 404 and/or washer coupled to a bolt that extends from the bases 402. Thus, the bases 402 may include bolts that extend through, for example, first apertures 128, 228 and/or second apertures 130, 230 defined in the first appendages 110, 210. In one example, the bases 402 may be coupled to the first appendages 110, 210 via clamping, or via screws, nails, rivets, lynch pins, cotter pins, locking pins, clevis pins, other fasteners and fastening methods, and combinations thereof. The bases provide a stable support onto which the right stair stringer 100 and the left stair stringer 200 may be seated. In one example, the bases 402 may, in turn, be coupled to a surface of the structure to provide additional support, but such coupling may not be required. The bases may include, for example, bases manufactured and distributed by MIRO Industries, Inc.

Having described a step 300 and a base-supported step 400 in FIGS. 9 through 13 and 14, respectively, FIG. 15 illustrates a perspective view of a crossover 500 including a number of the treads 302 of FIGS. 9 through 14 and a platform 502, according to an example of the principles described herein. As depicted in FIG. 15, the base-supported step 400 may support and be coupled to a platform 502 to create the crossover 500. A cross over 500 may be placed over, for example, pipes, ducts, expansion joints, and other objects that an individual may have difficulty stepping over and/or may be required by code or law to not step over or onto. In one example, the platform may include a number of treads 302 laid out along the length of the platform 502. The treads 302 may be coupled to a number of beams 506 that may be directly or indirectly coupled to the third appendages 114, 214 of the right stair stringer 100 and the left stair stringer 200 on both sides of the platform 502. In one example, two beams may be coupled to the treads 302 via any methods or devices including welding, gluing, clamping, or via screws, nails, rivets, lynch pins, cotter pins, locking pins, clevis pins, other fasteners and fastening methods, and combinations thereof. The beams 506 may, in turn, be coupled to the third appendages 114, 214 of the right stair stringer 100 and the left stair stringer 200 via any methods or devices including welding, gluing, clamping, or via screws, nails, rivets, lynch pins, cotter pins, locking pins, clevis pins, other fasteners and fastening methods, and combinations thereof. In one example, fasteners may be extended from or through the platform 502 and through the first apertures 134, 234 and/or second apertures 136, 236 of the third appendages 114, 214 in order to couple the platform 502 to the right stair stringer 100 and the left stair stringer 200.

In one example, a number of riser spacers 504 may be interposed between the beams 506 of the platform 502 and the third appendages 114, 214 of the right stair stringer 100 and the left stair stringer 200. The riser spacers 504, as described in more detail herein, may include a number of apertures through which a fastener may extend and which may align with the first apertures 134, 234 and/or second apertures 136, 236 of the third appendages 114, 214. The riser spacers 504 may be used in order to adjust the vertical height between the tread 302 of the base-supported step 400 and the top surface 308 of the platform 502 in order to match a distance from a surface of the rooftop on which the bases 402 sit and the top surface 308 of the tread 302 of the base-supported step 400. In this manner, an individual utilizing the crossover 500 may more easily walk over the crossover 500 without varying rise heights between steps. In this example, the inclusion of the bases 402 may be the reason for the need to adjust the rise height to match.

The platform 502 may include a top surface 308 that is similar or identical to the top surface 308 of a tread 302. The top surface 308 includes a grate to allow for precipitation including, for example, rain and snow, to drop through the platform 502 and to a surface underneath the platform 502 and/or the crossover 500. In one example, the top surface 308 may include any type of texturing, knurling, or similar slip resistant surface so that a risk of an individual slipping on the surface of the top surface 308. Thus, the tread 302 as described herein is fit to be placed outdoors including on, for example, a surface of a roof where precipitation may fall on the platform 502 and the crossover 500 without being subjected to significant deterioration through oxidation processes and remaining in a state where it may not be risky for an individual to use the crossover 500.

FIG. 16 illustrates a perspective view of a stair assembly 600 including a number of the treads 302 of FIGS. 9-14, according to an example of the principles described herein. As mentioned above, the right stair stringer 100 and the left stair stringer 200 may be coupled to other right stair stringers 100 and left stair stringers 200, respectively, to form a series of stringers 100, 200. A corresponding number of treads 302 may be coupled to the series of stringers 100, 200 to create a number of steps 300 that, in turn, form the stair assembly 600 (e.g., a stairway) as depicted in FIG. 16.

The bases 402 of the stair assembly 600 may be coupled directly to the first appendages 110, 210 of the right stair stringer 100 and the left stair stringer 200. The bases 402 may be coupled to the first appendages 110, 210 using any type of fastener or method of fastening including, for example, a nut 404 and/or washer coupled to a bolt that extends from the bases 402. Thus, the bases 402 may include bolts that extend through, for example, first apertures 128, 228 and/or second apertures 130, 230 defined in the first appendages 110, 210. In one example, the bases 402 may be coupled to the first appendages 110, 210 via clamping, or via screws, nails, rivets, lynch pins, cotter pins, locking pins, clevis pins, other fasteners and fastening methods, and combinations thereof. The bases provide a stable support onto which the right stair stringer 100 and the left stair stringer 200 may be seated.

However, in one example, the bases 402 may be indirectly coupled to the right stair stringer 100 and the left stair stringer 200. In this example, a number of vertical handrail stanchions 604 may be coupled to the right stair stringer 100 and the left stair stringer 200. For example, the first apertures 118, 218 and/or the second apertures 120, 220 defined in the horizontal arm 106, 206 of the body 102, 202 of the right stair stringer 100 and the left stair stringer 200 may be used to extend a number of fasteners therethrough and into or in coupling interface with the vertical handrail stanchions 604. Further, the vertical handrail stanchions 604 may be coupled to the bases 402 via a number of brackets and/or fasteners as depicted in FIG. 16. In this manner, the vertical handrail stanchions 604 serve as feet or supports to which the stair assembly 600 may be coupled and supported.

The vertical handrail stanchions 604 may also serve as stanchions to which a number of handrails 602 may be coupled. The handrails 602 provide stability and support to an individual using the stair assembly 600 as the individual ascends or descends the steps of the stair assembly 600. Further, the handrails 602 may provide a barrier to reduce or eliminate the possibility of an individual falling from the stair assembly 600. The handrails 602 may be coupled to the vertical handrail stanchions 604 via any methods or devices including welding, gluing, clamping, or via bolts, nuts, brackets, screws, nails, rivets, lynch pins, cotter pins, locking pins, clevis pins, other fasteners and fastening methods, and combinations thereof.

The stair assembly 600 of FIG. 16 may further include a number of internal supporting devices including a number of cross bracings 606 and struts 608. The cross bracings 606 may be coupled between vertical handrail stanchions 604. In one example, a number of fasteners may be extended into or in coupling interface with the vertical handrail stanchions 604 in order to couple the cross bracings 606 to the vertical handrail stanchions 604. The cross bracings 606 may remain in tension and stabilizes any lateral movement of the vertical handrail stanchions 604 such that the vertical handrail stanchions 604 do not separate from one another under any additional weight applied to the stair assembly 600. In one example, the cross bracings 606 may be coupled to two vertical handrail stanchions 604 from the left to the right of the stair assembly 600.

A number of struts 608 may also be used to stabilize the vertical handrail stanchions 604 in a direction perpendicular to the direction in which the cross bracings 606 stabilize the stair assembly 600. In one example, the struts 608 may be coupled to two or more vertical handrail stanchions 604 via any methods or devices including welding, gluing, clamping, or via bolts, nuts, brackets, screws, nails, rivets, lynch pins, cotter pins, locking pins, clevis pins, other fasteners and fastening methods, and combinations thereof. Further, the struts 608 may be coupled to two or more vertical handrail stanchions 604 in an approximately horizontal plane. In this orientation, a strut 608 may interface with at least one of the right stair stringer 100 or the left stair stringer 200 and may couple with the right stair stringer 100 or the left stair stringer 200 via the extension of a fastener through the first apertures 118, 218 defined in the horizontal arm 106, 206 of the body 102, 202 and into or in coupling interface with the strut 608. Again, the strut 608 may also be coupled to the vertical handrail stanchions 604. In this manner, the strut 608 may support the vertical handrail stanchions 604 and, in turn, the stair assembly 600. Specifically, the struts 608 may remain in tension and stabilize any lateral movement of the vertical handrail stanchions 604 such that the vertical handrail stanchions 604 do not separate from one another under any additional weight applied to the stair assembly 600. In one example, the struts 608 may be coupled to two vertical handrail stanchions 604 from the front to the back of the stair assembly 600 or along the same lateral direction as the progression of the steps along the stair assembly 600.

A number of riser spacers 504 may be coupled to the third appendage 114, 214 of a top step 300 of the series of steps 300 within the stair assembly 600. As described above in connection with the crossover 500 of FIG. 15, the riser spacers 504 may be interposed between the right stair stringer 100 or the left stair stringer 200 and any platform 502 or landing in order to adjust the vertical height between the tread 302 of the step 300, the base-supported step 400 and the top surface 308 of the platform 502 in order to match a distance from a surface of the rooftop on which the bases 402 sit and the top surface 308 of the tread 302 of the base-supported step 400. In this manner, an individual utilizing the stair assembly 600 may more easily traverse the stair assembly 600 without varying rise heights between steps. In this example, the inclusion of the bases 402 may be the reason for the need to adjust the rise height to match. In one example, a number of riser spacers 504 may also be included between one or more of the right stair stringers 100 and a series of left stair stringers 200 in the series of stringers 100, 200 to adjust the rise height between the right stair stringers 100 and a series of left stair stringers 200 to match that of the height between the surface on which the stair assembly 600 sits and the top of the first step 300, 400 and/or the rise height between the top of the top step 300, 400 and a platform 502 or landing coupled to the top step 300, 400.

With the understanding of the stair assembly 600 of FIG. 16, FIG. 17 illustrates a perspective view of a stair assembly 700 including a number of the treads 302 of FIGS. 9-14, according to an example of the principles described herein. The stair assembly 700 of FIG. 17 includes two separate stair assemblies 600 of FIG. 16 coupled together via a platform 502. The stair assembly 700 of FIG. 17 may be referred to as a crossover similar to the crossover 500 of FIG. 15, and may be used to assist an individual in crossing over pipes, ducts, expansion joints, and other objects that are relatively larger or held at a higher elevation thank those elements that pass under the crossover 500 of FIG. 15.

Further, in one example, the stair assembly 700 of FIG. 17 may include more steps 300, 400 on one side of the crossover relative to the other side. In this example, the stair assembly 700 of FIG. 17 may be used to bridge between a first surface of a structure (e.g., a first rooftop elevation) and a second surface of a structure (e.g., a second rooftop elevation) that are at different elevations. In many instances, rooftops, for example, may include different levels or elevations across the whole of the rooftop. In this example, the stair assembly 700 of FIG. 17 may be installed over the elevation change or transition between the two levels or elevations of the rooftop and may be used to traverse this elevation change.

The stair assembly 700 of FIG. 17 may include a platform 502 coupled to two separate stair assemblies including pairs of series of stringers 100, 200 and a corresponding number of treads 302 to form a number of steps 300, 400. Also, as described herein, the stair assembly 700 of FIG. 17 may include a number of bases, 402, riser spacers 504, handrails 602, vertical handrail stanchions 604, cross bracings 606, and struts 608 as needed to stabilize and support the stair assembly 700. In one example, a top step 300, 400 of at least one side of the stair assembly 700 may be coupled to a wall or similar vertical portion of the structure to further stabilize and support the stair assembly 700. In this example, a number of fasteners may be extended through the first apertures 132, 232 defined in the fourth appendage 116, 216 of the right stair stringer 100 and the left stair stringer 200 and into or in coupling interface with the wall.

Further, as depicted in FIG. 17, the handrails 602 may extend up and down the stair assembly 700 as well as across the platform 502. The handrails 602 that run across the platform 502 server to reduce or eliminate the potential of an individual falling from the platform 502.

FIG. 18 illustrates a perspective view of a riser spacer 504 that may be included within a stair assembly 600, 700, crossover 500 or similar assembly, according to an example of the principles described herein. The riser spacer 504 may include a body 1802. The body 1802 may include first apertures 1804 and second apertures 1806 defined therein. The first apertures 1804 may be used to allow for fasteners extending through the first apertures 134, 234 of the third appendage 114, 214 of the right stair stringer 100 and the left stair stringer 200. Thus, the first apertures 1804 defined in the body 1802 of the riser spacer 504 may be positioned to align with the first apertures 134, 234 of the third appendage 114, 214 of the right stair stringer 100 and the left stair stringer 200 in order to accommodate the fasteners to extend through both the first apertures 134, 234 and the first apertures 1804.

Similarly, the second apertures 1806 defined in the body 1802 of the riser spacer 504 may be positioned to align with the second apertures 136, 236 of the third appendage 114, 214 of the right stair stringer 100 and the left stair stringer 200 in order to accommodate the fasteners to extend through both the second apertures 136, 236 and the second apertures 1806.

The right stair stringers 100, the left stair stringers 200, the treads 302, the end caps 304, the top surface 308 of the treads 302, the bases 402, the platforms 502, the riser spacers 504, the beams 506 of the platform 502, the handrails 602, the vertical handrail stanchions 604, the cross bracings 606, the struts 608, any fasteners used to coupled these elements together, and other elements described herein may be made of materials that may or may assist in bearing the weight of a plurality of individuals. For example, these elements may be made of metals, metal alloys, carbon fiber materials, plastics, and other materials, and combinations thereof. The bases 402 may be made of plastics or similar materials. The metals used in these elements may be subjected to a number of treatments to reduce or eliminate oxidation, corrosion, rusting, or other forms of deterioration due to exposure to an environment including exposure to precipitation, solar light, and heat, etc. For example, these elements may be subjected to galvanization, powder coating, painting, ultraviolet light protective coating, other forms of anti-deterioration methods and techniques, and combinations thereof.

CONCLUSION

The examples described herein provide pairs of stair stringers that may be used to build a stairway system when coupled together in a series of stair stringers. The stair stringers may support platforms, landings, handrails, vertical handrail stanchions, cross bracings, struts, and other devices to assist in increasing stability of the stairway and increasing safety of an individual traversing such a stairway.

With the above-described systems and methods, an installer of the stairway may modularly assemble a stairway to fit a particular application and may do so at the sight of installation without pre-assembling the stairway and transporting the stairway to the sight of installation. Further, if and when elements of the stairway require replacement, just that element may be replaced with out replacing significant portions of the stairway.

While the present systems and methods are described with respect to the specific examples, it is to be understood that the scope of the present systems and methods are not limited to these specific examples. Since other modifications and changes varied to fit particular operating requirements and environments will be apparent to those skilled in the art, the present systems and methods are not considered limited to the example chosen for purposes of disclosure, and covers all changes and modifications which do not constitute departures from the true spirit and scope of the present systems and methods.

Although the application describes examples having specific structural features and/or methodological acts, it is to be understood that the claims are not necessarily limited to the specific features or acts described. Rather, the specific features and acts are merely illustrative of some examples that fall within the scope of the claims of the application.

What is claimed is:

1. A stair stringer, comprising:
- a body including:
  - a horizontal arm;
  - a center angled portion coupled to the horizontal arm; and
  - a vertical arm coupled to the center angled portion;
- a first appendage coupled to a first edge of the horizontal arm;
- a second appendage coupled to a second edge of the horizontal arm;
- a third appendage coupled to a third edge of the vertical arm; and
- a fourth appendage coupled to a fourth edge of the vertical arm, the fourth edge being adjacent the third edge,
- wherein the fourth appendage extends from a first side of the body opposite a second side of the body from which the first appendage, the second appendage, and the third appendage extend.

2. The stair stringer of claim 1, wherein the first appendage, the second appendage, and the third appendage are parallel with respect to one another.

3. The stair stringer of claim 2, wherein a vertical distance between the second appendage of a first stair stringer and the second appendage of a second stair stringer coupled to the first stair stringer defines a tread rise between two treads of a stairway.

4. The stair stringer of claim 2, wherein a horizontal distance from a first end of the horizontal arm and a second end of the horizontal arm defines a tread depth of a tread of a stairway.

5. The stair stringer of claim 1, further comprising a nosing extending from the vertical arm, the third appendage extending to a distal end of the nosing relative to the third appendage.

6. The stair stringer of claim 1, further comprising a plurality of first apertures defined in the first appendage, the first apertures including a pattern that matches a plurality of second apertures defined in the third appendage.

7. The stair stringer of claim 1, further comprising a plurality of apertures defined in the first appendage, the apertures including a pattern that matches a plurality of fasteners of a base.

8. The stair stringer of claim 1, further comprising a plurality of first apertures defined in the second appendage, the first apertures including a pattern that matches a plurality of second apertures defined in a tread.

9. The stair stringer of claim 1, further comprising a plurality of apertures defined in the fourth appendage.

10. The stair stringer of claim 1, further comprising a plurality of apertures defined in the vertical arm and the horizontal arm.

11. A stairway system, comprising:
- a first stair stringer;
- a second stair stringer, the second stair stringer being an architectural chiral with respect to the first stair stringer;

wherein the first stair stringer and the second stair stringer include:

a body including:

a horizontal arm;

a center angled portion coupled to the horizontal arm; and a vertical arm coupled to the center angled portion;

a first appendage coupled to a first edge of the horizontal arm;

a second appendage coupled to a second edge of the horizontal arm;

a third appendage coupled to a third edge of the vertical arm;

a fourth appendage coupled to a fourth edge of the vertical arm, the fourth edge being adjacent the third edge; and a plurality of first apertures defined in the first appendage, the first apertures including a pattern that matches a plurality of second apertures defined in the third appendage; and a tread coupling the first stair stringer to the second stair stringer.

12. The stairway system of claim 11, wherein:

the first appendage, the second appendage, and the third appendage are parallel with respect to one another, a vertical distance between the second appendage of the first stair stringer and the second appendage of a third stair stringer coupled to the first stair stringer defines a rise between a plurality of the treads of a stairway, and a horizontal distance from a first end of the horizontal arm and a second end of the horizontal arm defines a tread depth of the tread.

13. The stairway system of claim 11, further comprising a nosing extending from the vertical arm, the third appendage extending to a distal end of the nosing relative to the third appendage.

14. The stairway system of claim 11, further comprising at least one of:

a number of third apertures defined in the first appendage, the third apertures being aligned with a corresponding number of first fasteners of a base such that the first appendage is couplable to the base;

a number of fourth apertures defined in the second appendage, the fourth apertures being aligned with a corresponding number of apertures defined in the tread such that the second appendage is couplable to the tread via a number of second fasteners;

a number of fifth apertures defined in the fourth appendage to couple the first stair stringer or the second stair stringer to a structure via a number of third fasteners extended through the fifth apertures and into the structure;

a number of sixth apertures defined in the vertical arm and the horizontal arm to couple the first stair stringer or the second stair stringer to a structure via a number of fourth fasteners extended through the apertures and into the structure; or combinations thereof.

15. The stairway system of claim 11, further comprising a handrail system coupled to the stairway system via at least one of the first stair stringer and the second stair stringer.

16. The stairway system of claim 15, further comprising a number of cross supports coupled to the handrail system.

17. The stairway system of claim 11, further comprising a platform coupled to a number of first stair stringers and a corresponding number of second stair stringers.

18. The stairway system of claim 11, further comprising a number of struts coupled to the stairway system via the first stair stringer and the second stair stringer.

19. The stairway system of claim 11, further comprising a number of riser spacers coupled to the third appendage of the vertical arm.

20. The stairway system of claim 11, further comprising a number of bases coupled to a lowest one of a number of the first stair stringers and a corresponding number of the second stair stringers.

* * * * *